US008646415B2

(12) United States Patent
Betzer Tsilevich

(10) Patent No.: US 8,646,415 B2
(45) Date of Patent: Feb. 11, 2014

(54) SYSTEM AND METHOD FOR ZERO LIQUID DISCHARGE

(75) Inventor: Maoz Betzer Tsilevich, Woodbine (CA)

(73) Assignee: Ex-Tar Technologies, Woodbine, SW Calgary (CA)

( * ) Notice: Subject to any disclaimer, the term of this patent is extended or adjusted under 35 U.S.C. 154(b) by 649 days.

(21) Appl. No.: 12/907,009

(22) Filed: Oct. 18, 2010

(65) Prior Publication Data

US 2011/0036308 A1 Feb. 17, 2011

Related U.S. Application Data

(63) Continuation-in-part of application No. 12/406,823, filed on Mar. 18, 2009.

(51) Int. Cl.
*F22B 5/04* (2006.01)

(52) U.S. Cl.
USPC ..... 122/11; 122/367.4

(58) Field of Classification Search
USPC ..... 122/11, 12, 367.1; 432/72, 73, 85, 103; 110/234, 246
See application file for complete search history.

(56) References Cited

U.S. PATENT DOCUMENTS

| | | | | |
|---|---|---|---|---|
| 1,313,281 | A | 8/1919 | Fasting | |
| 1,855,819 | A | 4/1932 | Blomquist et al. | |
| 1,857,785 | A * | 5/1932 | Holzapfel | 366/229 |
| 2,916,877 | A | 12/1959 | Walter | |
| 3,493,344 | A * | 2/1970 | St. Clair | 165/8 |
| 4,060,587 | A * | 11/1977 | Lewis | 423/210 |
| 4,207,290 | A * | 6/1980 | Lee | 422/109 |
| 4,398,604 | A | 8/1983 | Krajicek et al. | |
| 4,463,803 | A | 8/1984 | Wyatt | |
| 4,583,468 | A * | 4/1986 | Reed et al. | 110/246 |
| 5,005,493 | A * | 4/1991 | Gitman | 110/246 |
| 5,711,018 | A * | 1/1998 | Hittner et al. | 588/314 |
| 6,213,030 | B1 * | 4/2001 | Robertson et al. | 110/246 |
| 7,814,867 | B2 * | 10/2010 | Betzer Tsilevich | 122/11 |
| 7,959,435 | B2 * | 6/2011 | Hansen et al. | 432/108 |

FOREIGN PATENT DOCUMENTS

| | | |
|---|---|---|
| GB | 0 328 339 | 5/1930 |
| JP | 581 153 576 | 9/1983 |
| RU | 2 285 199 | 12/2004 |

* cited by examiner

*Primary Examiner* — Gregory A Wilson
(74) *Attorney, Agent, or Firm* — Andrew W. Chu; Craft Chu PLLC

(57) ABSTRACT

The present invention is a system and method for generating a mixture of steam and combustion gas in a direct contact rotating steam generator, using high solids content water, and without waste liquid discharge. The invention includes removing the solids with controllable water content in a stackable form. The system includes a longitudinally rotatable and controlled pressure enclosure being mounted at a slope and having a steam producing section, a water injection section and a discharge section. The enclosure can include a mixing and mobilizing rotating element to enhance the mixture and the heat transfer. The system can have an additional wet section to scrub contaminates and produce saturated steam. The system can be integrated with an enhanced oil recovery facility or with an open mine oil facility that generates non-segregate tailings to consume their discharge liquid waste and generate steam, heat and a stable solids waste.

10 Claims, 26 Drawing Sheets

SYSTEM AND METHOD FOR ZERO LIQUID DISCHARGE

RELATED U.S. APPLICATIONS

The present application is a continuation-in-part application under 35 U.S. Code Section 120 of U.S. application Ser. No. 12/406,823, filed on Mar. 18, 2009, and entitled "DIRECT CONTACT ROTATING STEAM GENERATOR USING LOW QUALITY WATER WITH ZERO LIQUID DISCHARGE", presently pending.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to an apparatus and method to produce steam, gas and stable solid waste without wastewater discharge. Carbon or hydrocarbon fuel and low quality water (like non-segregating fine tailings, brine from distillation facility, sludge from water softening process and sewage) can be used in a direct contact heat exchange process.

2. Description of Related Art Including Information Disclosed Under 37 CFR 1.97 and 37 CFR 1.98.

The main characteristic of a direct contact steam generator is that the produced steam contains impurities, such as combustion products (mainly gases and possible solids) that were burned during steam production. Those gases are mainly carbon dioxide and nitrogen, when air is used for stoichiometric combustion processes. Additional gases can be present in smaller percentages, such as CO, SOX, NOX and other gases.

The need for the present invention is driven by challenges facing the heavy oil production industry involved with enhanced oil recovery (EOR) and is especially driven by the negative environmental effect of that type of oil development. For example, steam assisted gravity drainage (SAGD), cyclic steam stimulation (CSS) and open mining of tar sands generate large amounts of tailing water and CO2 emissions. Indirect steam generators, mainly Once Through Steam Generators (OTSG) and steam boilers, are currently used for commercial projects. In the prior art systems, the facilities generate large amounts of wastewater from the water treatment plants (like evaporator brine, lime softening sludge, filter backwash etc). The blow-down from the steam generation facility, especially if OTSG is used, also generates large amounts of wastewater with high levels of solids. With open mine oil sand facilities, due to the separation process of the tar from the bitumen, large amounts of non-segregate fine tailings are generated. There is also a need to use the extensive heat process to extract pure water from the wastewater while recovering the heat and producing a stackable solid waste that can support traffic. There is also a need to utilize low quality carbon fuels such as coal, coke, and asphaltin as the energy source for steam production in the heavy oil production industry to replace the widespread use of natural gas. Natural gas is a clean and valuable resource that, from a public perspective, should not be used for steam production in heavy oil extraction. This clean resource should be preserved and used for residential purposes. The present invention can work with natural gas or other clean liquid/gas fuels, however, due to its ability to handle the solids, both from the water and the fuel as well as its ability to remove SO2, the use of dirty fuel and low quality water is preferred.

Various patents have been issued that are relevant to the present invention. For example, U.S. Pat. No. 2,916,877, issued on Dec. 15, 1959 to Walter, teaches a pressure fluid generator, which utilizes direct-contact heat transfer. The pressure fluid generator is in the form of an elongated combustion chamber. A coolant in the heat exchange relationship is injected into the combustion chamber to form with the combustion products therein, as a gas and superheated vapor-working mixture at a relatively high temperature and pressure. Some embodiments include in-line soot filters and circulated water, and the fuel is hydrocarbon gas.

U.S. Pat. No. 4,398,604, issued on Aug. 16, 1983 to Krajicek et al. describes a system for aboveground stationary direct contact horizontal steam generation. The method and apparatus produces a high-pressure thermal vaporized stream of water vapor and combustion gases for recovering heavy viscous petroleum from a subterranean formation. High-pressure combustion gases are directed into a partially water-filled vapor generator vessel to produce a high-pressure stream of water vapor and combustion gases. The produced solids are continually removed with reject water.

There are also patents relating to applications in heavy oil production. U.S. Pat. No. 4,463,803, issued to Wyatt on Aug. 7, 1984 describes a system for down-hole stationary direct contact steam generation for enhanced heavy oil production. The method and apparatus generate high-pressure steam within a well bore. The steam vapor generator is constructed for receiving and mixing high-pressure water, fuel and oxidants in a down-hole configuration. The produced solids are discharged to the oil reservoir.

Various patents have disclosed rotational elements of steam generators. U.S. Pat. No. 1,855,819, issued on Apr. 26, 1932 to Blomquist et al. describes a rotary boiler, where the pressure chamber is rotating inside the combustion area while producing the steam in an adjacent indirect heat exchanger. To increase the efficiency of the invention, Blomquist used scraper chains within the steam generating tubes, to prevent the sludge from adhering to the tubes interior walls. British patent No. 0 328 339, issued on May 1, 1930 to Kalabin teaches a direct contact steam generator with a rotating pressure vessel. The gasses flow to a rotating chamber, where they are mixed with air and combusted completely. Water covers the walls of the rotating chamber. This is achieved by the centrifugal force of the rotating chamber, exposing the water to gas combustion.

Various patents have disclosed rotating drums with chains as heat exchange elements. These are designed to capture heat from the combustion gas and transfer it to the liquid or slurry medium. U.S. Pat. No. 1,313,281, issued on Aug. 19, 1919 to Fasting describes a rotary kiln for slurry material. The chains lift the slurry onto the path of the hot combustion products, to increase the heat transfer and slurry evaporation. U.S. Pat. No. 4,207,290, issued on Jun. 10, 1980 to Lee, discloses a flue gas scrubber. The elongated tubular drum scrubber, fitted with chains as means of heat transfer, is used for increasing the direct contact between lime slurry and sulfur rich flue gas. The rotating scrubber has two main areas: a scrubbing area with liquid slurry and a drying area. In the drying area, the heat from the flue gas evaporates the moisture to generate dry pellets.

It is an objective of the present invention to provide an apparatus and method for the production of steam and solid waste using a direct contact heat transfer between available low quality water and combustion gases in a rotating or fluid bed reactor.

It is another object of the present invention to provide an apparatus and method where the waste solids are separated and removed in the form of dry particles or high concentrated slurry from the rotating steam generator by rotating apparatus, with a controlled amount of water.

It is another object of the present invention to provide an apparatus and method that produces steam from low-quality tailing pond and reject-water containing high levels of dissolved inorganic solids or organic solids. All liquid water is converted to steam and no liquid is discharged from the apparatus.

It is another object of the present invention to provide an apparatus and method that produces steam from low-quality fuel containing inorganic impurities. For example fuels like coal, coke, asphaltin or any other available carbon based fuel, wherein the combustion byproducts of this fuel are slag and ash in solid form.

It is another objective of the present invention to provide an apparatus where evaporator brine is heated by combustion gas and converted to steam and solids, while the heat to evaporate the brine is under a controlled pressure; the heat is used to operate the evaporator that operates in lower pressure and temperature.

It is a further objective of the present invention to provide an apparatus and method where the concentrate from the crystallizer is heated by combustion energy in direct contact to generate steam and stackable solids and the heat is recovered to operate the crystallizer and possibly the evaporator.

It is an object of the present invention to reduce the need to remove solids from the discharge flow.

It is an object of the present invention to integrating a solids removal step during rotation of a direct contact steam generator.

These and other objects and advantages of the present invention will become apparent from a reading of the attached specification and appended claims.

SUMMARY OF THE INVENTION

The method of the present invention includes additional information with regard to rotation steam generation (especially for the use of MFT) and the discharge of stable slurry. The basic steps of the process still include the following: (1) mixing a low quality fuel containing carbon or hydrocarbon fuel and oxidizing gas like oxygen, enriched air or air in an enclosure; (2) combusting the mixture under controlled pressure and temperature; and (3) mixing water, possibly with high total dissolved and suspended solids content (like silica, calcium, magnesium, sodium, carbonate or organics) within the combusted mixture so as to generate steam and possibly control reactor temperature. The present invention further includes the steps of adding liquid water into the enclosure, like with the low quality water, to control the humidity content of the discharged solids and using a discharge hopper fixed perpendicular to the enclosure. The present invention may include the steps of adding liquid water into a section in the enclosure, where the liquid water, scrubbed solids and acid gas remains, while generating additional saturated steam. The saturated water with the scrubbed solids is recycled back to the DCSG high temperature area where the liquid water is transferred to steam, releasing the solids. The present invention may include the steps of adding a large quantity of cold process water and mixing them with the produced steam and combustion gas, after the solids were removed in a dry form, in the enclosure to condense the steam into the hot process water and to generate a flow of hot process water that can be used for bitumen extraction.

The present invention is also a system with a pressurized and rotatable enclosure for producing a steam and combustion gas mixture without generating liquid waste. The energy to operate the reaction chamber can be generated internally or externally, wherein the reaction chamber is a combustion chamber, being pressurized and rotatable or the reaction chamber is attached to a pressurized fixed combustion vessel, possibly equipped with heat exchanger, like in a boiler. The chamber and combustion vessel are both pressurized and are in direct fluid communication with one another. In either configuration, the reaction chamber can be partially filled with lifting scoops, free moving embodiments of chains for internal cleaning and for increasing the heat transfer area. It has a solids discharge outlet at one end thereof. The waste solids generated by the combustion and steam generation are driven by gravity to regenerated surfaces at the bottom of the rotating drum. The heat transfer rate is increased by the use of lifting scoops, chains attached to the rotating drum walls or free moving particles within the drum. The chains regenerate their own surface and the vessel's internal walls/surfaces due to their movement to prevent solids build-ups in the rotating chamber. The free moving bodies or chains, because the rotating movement continually cleans their exposed surfaces, can be constructed from special alloys that work as catalyst to improve the combustion reactions in the chamber. Course solid particles can be a part from the water feed. They can increase the heat transfer and removed the fine solids, like the solids that were introduced to the system dissolved in the water. The outlet has the discharge hopper attached so that solids can be discharged while the enclosure is rotating.

DETAILED DESCRIPTION OF THE DRAWINGS

Figure 1:
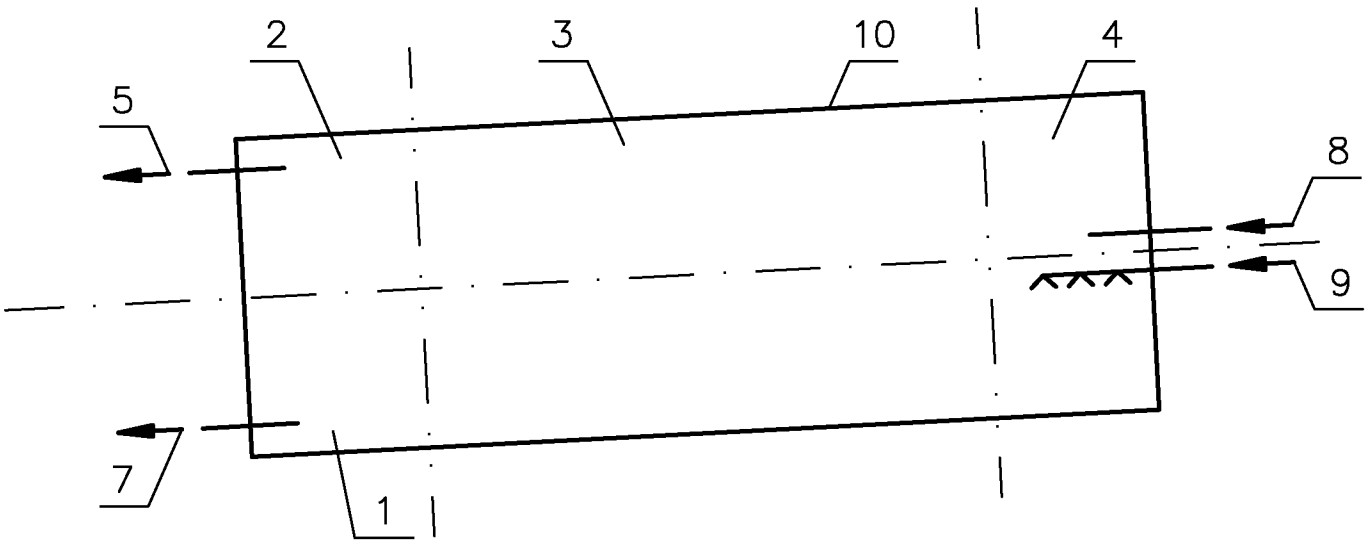
FIG. 1 is a direct contact, parallel-flow, horizontally-sloped pressure control reaction chamber apparatus of the present invention for generating stable solids and steam rich gas.

FIG. 1 shows the direct contact reaction chamber apparatus of the present invention for generating stable solids and steam rich gas. A parallel-flow horizontally-sloped pressure control sealed drum 10 is continually rotating, or rotating at intervals. Energy 8 is introduced at section 4, a high point of the sloped enclosure 10. The energy can be in the form of hot combustion gases generated by a separate unit like the pressurized boiler (not shown), or a mixture of fuel and oxidizer that are internally combusted inside section 4 of the enclosure. The fuel can be coal, coke, or hydrocarbons such as untreated heavy low quality crude oil, VR (vacuum residuals), asphaltin, and natural gas or any other available carbon or hydrocarbon fuel. The oxidizer is a gas (pure oxygen, air, or enriched air). The pressure inside the rotating drum is higher than 1 bar, preferably higher than 103 kpa. The enclosure 10 includes a heat transfer section 3. This section is located between the low quality water supply 9 and the solid discharge 7. This section can include scoops for lifting liquids and solids to increase their heat transfer area with the flowing gas. It can also be partially filled with heat transfer embodiments, like chains that are internally connected to the rotating wall and are free to move. Any other embodiments that are free, or partially free to move, can be used as well. The ash and solid deposits left from the combustion and the liquid solid evaporation (mainly solids that were generated from clay-like kaolin or metakaolin, silica based materials, calcium based materials-like calcium sulfite and calcium sulfate, heavy metals etc. that result from the specific type of fuel and water in use) are settled on the exposed surfaces. Due to the rotational movement the solids removed from the walls of vessel 10. Low quality water 9, like non segregated fine tailings, mature fine tailing (MFT) pond water, rich with solids and other contaminants (like oil based organics) are injected into the opposite higher side of the vessel at section 4 where they are mixed with the hot combustion gases and converted into steam and solids. This heat exchange and phase exchange continues at the heat exchange section 3 where the heavy liquids and solids are mixed and move downwards, with the combustion gases. The combustion gases injected or generated in section 4, located at the higher side of the sloped vessel, move downwards while converting liquid water to gas. The heat exchange between the gases to the liquids is increased by the use of lifting scoops and free-movement bodies like chains that maintain close contact, both with the hot combustion gas and with the liquids at the bottom of the rotating vessel.

The amount of injected water is controlled to produce steam and the solids carried by the low quality water become dry or semi-dry high solids concentration slurry and most of the liquids become gases. Additional chemical materials can be added to the reaction, preferably with the injected water 9. For example, limestone slurry can be added to the low quality water. Another option to replace the chains can be if the feed water naturally include solid particles like gravel aggregates. It is also possible to add free moving bodies, like limestone particles, to the water feed 9. When the liquids (primarily water) evaporate, the solids settle on the solid particles. To increase the heat transfer scoops lifters can be used to lift the solid particles and liquid and mixed them with the flowing gas. The rotational movement removes the solid deposits to the discharge section. The heat transfer in section 3 is sufficient to provide a homogenous mixture of gas and ground-up solids or high viscosity slurry. Most of the remaining liquid transitions to gas and the remaining solids are moved to a discharge point 7 at the lower internal section of the rotating enclosure. The solids or slurry released from the vessel 10 are stable and can be used for back-fill and to support transportation vehicles. The solids composition is strongly dependent on the low quality water that was used and on the fuel. If the water included lime stone and kaolin rich clay, the solids will include calcium sulfate, calcium sulfite and metakaolin which is more stable then inert solids, like silica, due their tendency to connect with water as crystal water. The produced gas 5, which includes the combustion gas and steam, is discharged from the upper section 2.

Figure 2A:
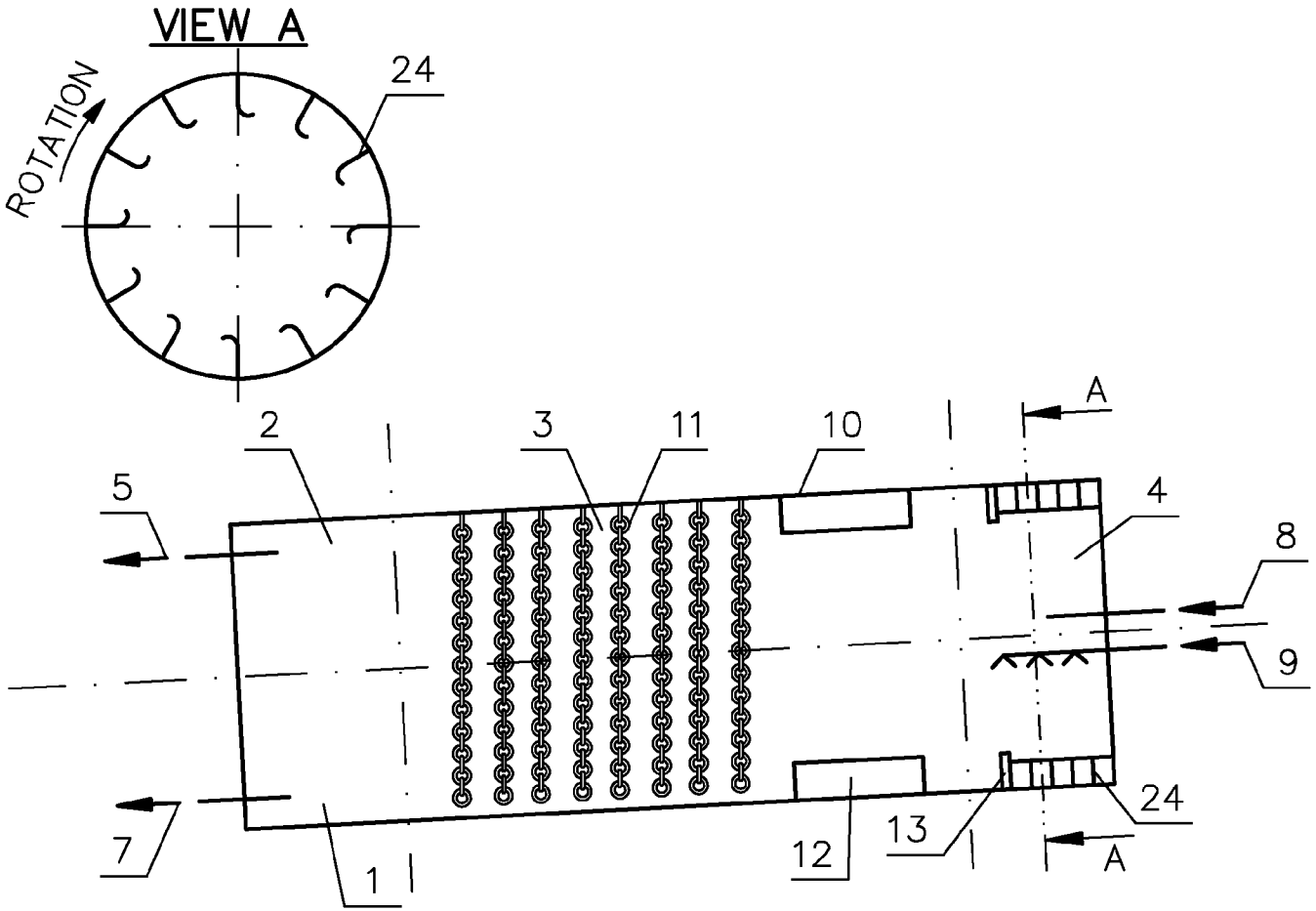
FIG. 2A shows the direct contact reaction chamber apparatus of the present invention for generating solids and solids free saturated steam rich gas.

FIG. 2A shows the direct contact reaction chamber apparatus of the present invention for generating solids and solids free saturated steam rich gas. A parallel-flow horizontally-sloped pressure control sealed drum is described in FIG. 2. This figure shows the lifting scoops 24 at section 4. The feed water 9 is lifted and mixed with the hot feed combustion gas 8 for externally fired DCSG, or is lifted to the combustion area in internally fired steam generator where the combustion occurs in section 4. The heat transfer section 3 can includes additional lifting scoops 12. In can also includes chains 11 to increase the heat transfer between the liquids, solids and slurry and the combustion gas and to remove and mobilize the stable slurry and solids. Most of the liquid transitions to gas and the remaining solids are moved to a discharge point 7 at the lower internal section of the rotating enclosure. The solids or slurry released from the vessel 10 are stable and can be used for back-fill and to support transportation vehicles. The produced gas 5, which includes the combustion gas and steam, discharges from the upper section 2.

Figure 2B:
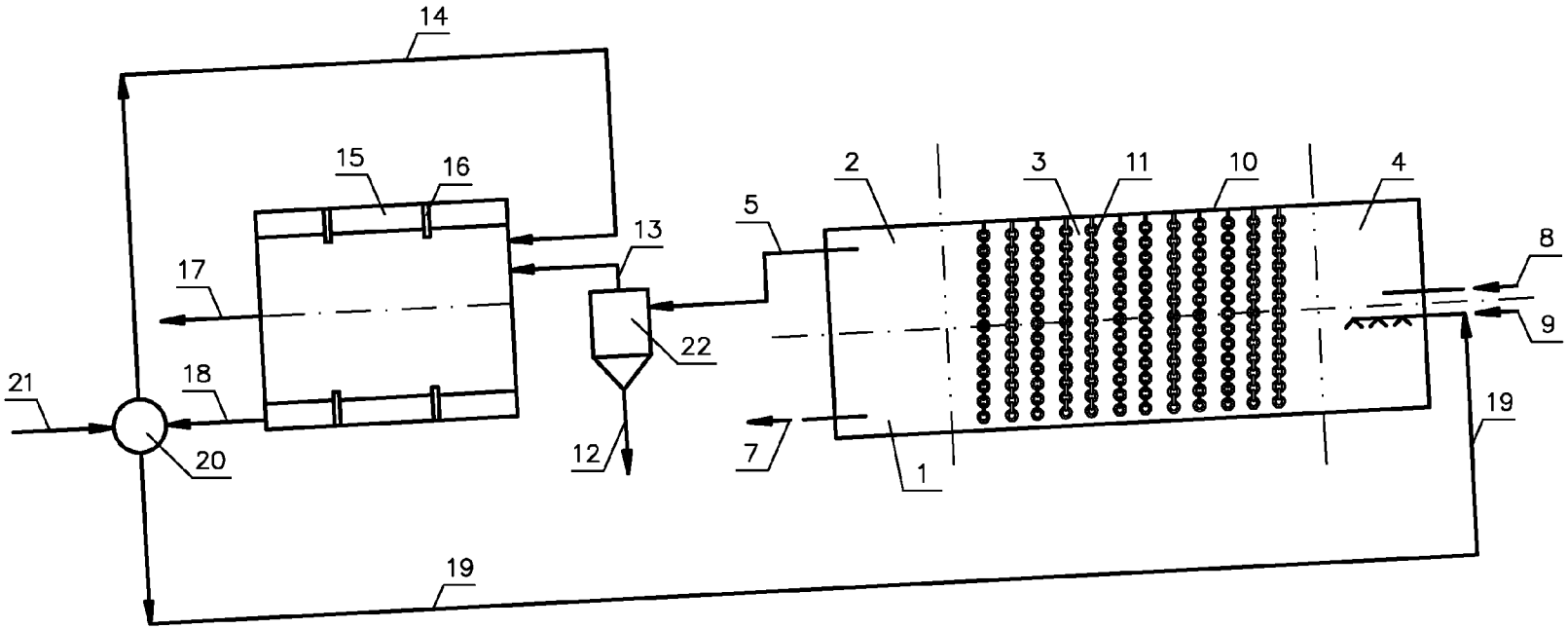
FIG. 2B is a direct contact reaction chamber apparatus of the present invention for generating solids free saturated steam gas flow by integrated rotating scrubber.

FIG. 2B shows the direct contact reaction chamber apparatus of the present invention for generating the solids free saturated steam gas flow 17. It includes a horizontally-sloped pressure control sealed drum as described in FIG. 2 or FIG. 2A. Solids rich water 19, possibly with additional feed water 9, possibly with alkaline material like lime stone, is injected at the highest point of sloped vessel 10. Most of the remaining liquid transitions to gas and the remaining solids are moved to a discharge point 7 at the lower internal section of the rotating enclosure. The solids or slurry released from the vessel 10 are stable and can be used for back-fill and to support transportation vehicles. The produced gas 5, which includes the combustion gas and steam, discharges from the upper section 2. If there is still a large amount of fly solids in the produced steam and combustion gas mixture, an additional solid separation unit 22 can be added to remove additional solids. The solids lean flow is injected into rotating enclosure 15 where it mixed with additional liquid water. The excessive heat evaporates a portion of the liquid water while generating saturated steam and combustion gas mixture. The liquid water also scrubs any remaining solids from the gas flow while possibly generating additional steam from liquid water. Water 14 is recycled in the rotating scrubber (which can also be defined as saturated (wet) steam generator. Enclosure 15 can include a mechanism to use the rotating movement of enclosure 15 to mix the liquid water and the flowing gas. Such mechanisms can include lifting scoops 24 that can be separated from each other by separator 25. Due to the rotating movement, the lifting scoops lift liquid water and spreads it on the flowing gas 13. Another mechanism option can be to include chains as described before. Some of the water 14 evaporates to generate steam. The remaining liquid water is scrubbed of any solids remains in the flowing gas 13. Make-up water 21, possibly with alkaline material like limestone to scrub sulfur, is added to replace the evaporated water and the water that is recycled back 19 to the enclosure 10 for mixture with the combustion gases 8. The liquid water 18 being discharged from enclosure 15 is separated in separator 20. The separator can be any commercially available separator that can be based on gravity, centrifuge forces, mesh etc'. The solid lean flow is recycled back to the rotating scrubber 15 while the solids rich flow 19, possibly with the limestone remains, is recycled back to enclosure 10 where it mixes with the combustion gas 8 or directly into the combustion area, if a direct fired unit is used where the combustion occurs inside enclosure 10 in section 4. The product is a saturated steam and combustion gas mixture 17. The solids 7 are removed in a dry or semi-dry form for safe disposal or for further treatment.

Figure 2C:
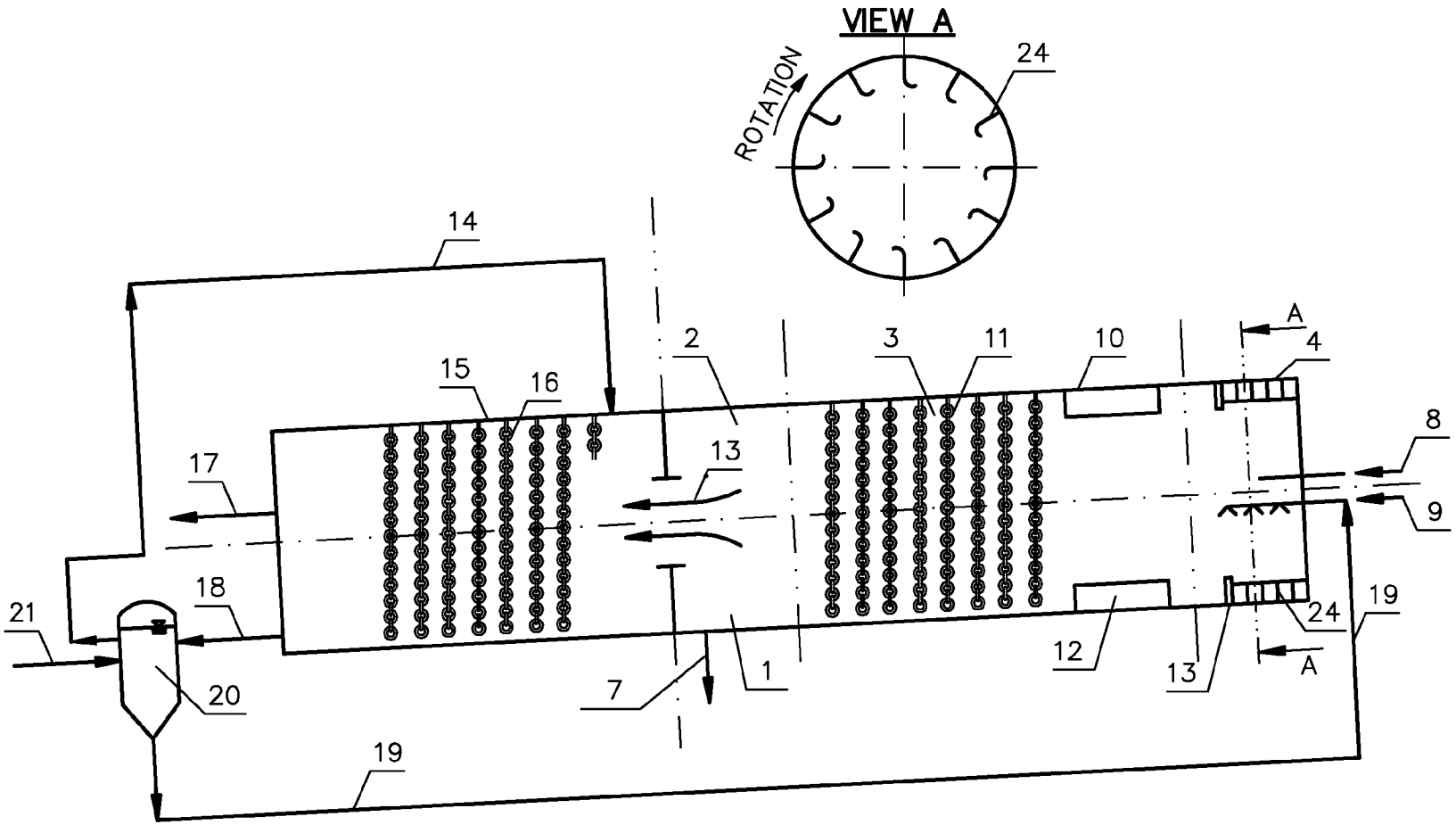
FIG. 2C shows the direct contact reaction chamber apparatus of the present invention for generating solids free saturated steam gas flow in an integrated rotating enclosure.

FIG. 2C shows the direct contact reaction chamber apparatus of the present invention for generating solids free saturated steam gas flow 17 in an integrated rotating enclosure. It includes a horizontally-sloped pressure control sealed enclosure. The enclosure includes two sections—a "dry" steam generation section for generating a dry steam and combustion gas mixture 13 and a stable solid discharge 7 that can disposed of in landfill, and a "wet" section for scrubbing the solids remains and possibly other contaminations, producing a scrubbed steam and combustion gas mixture 17. Energy 8 is introduced to the rotating enclosure in the form of hot combustion gas or as a mixture of fuel and oxidizing gas like air. Contaminated water, possibly with hydrocarbons, dissolved solids or suspended solids 9, and solids rich water 19 from the wet scrubber, are injected into the first section of the rotating enclosure 4. To improve the mixture and heat exchange with the combustion gas, a lifting means can be installed at 12 and 24. Cylindrical dividers like 13 can be installed as well to maintain the water level. Chains or other means can also be used to increase the mixture, the heat transfer and to remove solid deposits. Solids 7 in a dry or semi-dry form, are discharged from the solid discharge section 2. The gas flows through a separation in the rotating enclosure into a wet scrubber that is also the saturated (wet) steam generation section in the rotating enclosure. In this section, the produced steam and gas mixture 13 is mixed with saturated water where solids and contaminates are scrubbed by the liquid water. Liquid water transfers its phase and turns into steam gas which is at the same temperature as the saturated water. The water 18 with the scrubbed contaminates flows to the separator where a portion, which is the solid lean portion, is recycled to the scrubber while the solids rich portion is recycled back to the first section where the carried water evaporates and the solids are removed in a dry form 7. Make-up water 21 is fed into the system to replace the liquid water that was turned into steam. The product 17 is scrubbed combustion gas with steam in a saturated form. The scrubber portion 15 is integrated inside the same rotating enclosure and it can include elements to enhance the mixture between the gas phase and the liquid water 14, like chains 16 or a lifting means 24 (not shown in this section).

Figure 3:
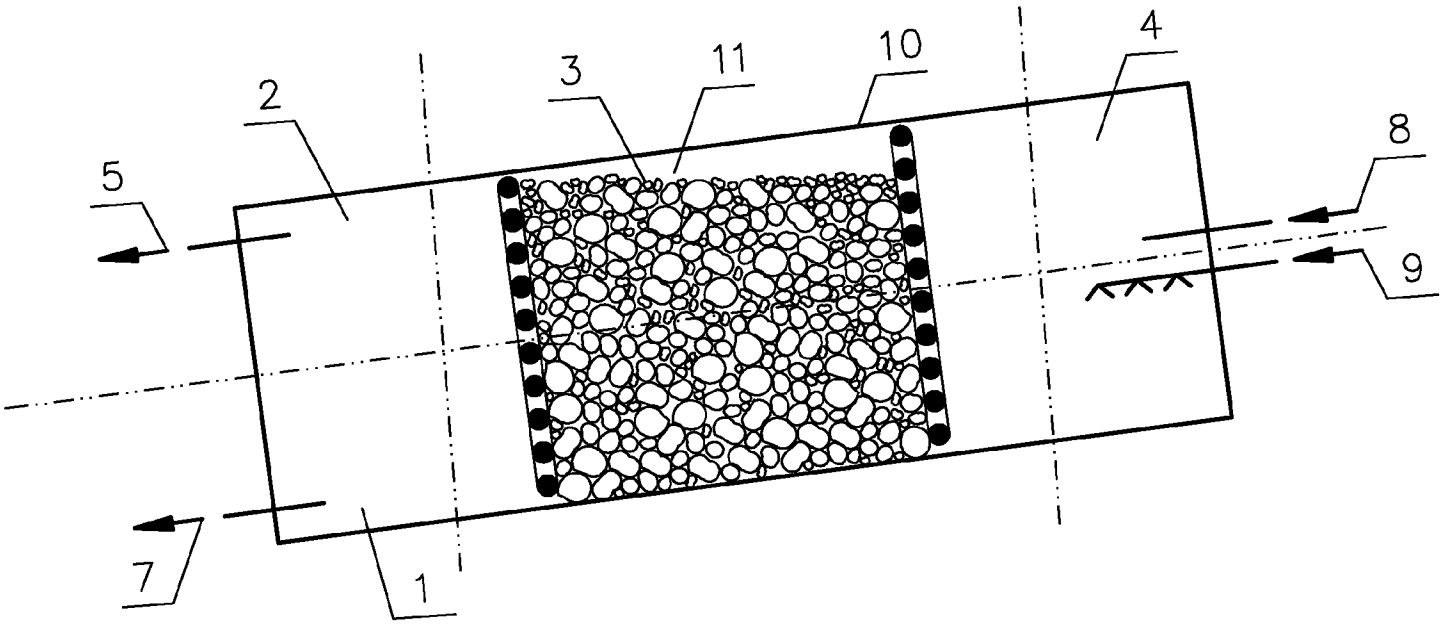
FIG. 3 describes a steam generation reactor with free round embodiment heat transfer section for parallel flow.

FIG. 3 describes a steam generation reactor similar to the steam generation reactor described in FIG. 2 but with a different heat transfer section 3. The heat transfer section is partly filled with round embodiments 11 that are free to move due to the rotational movement. The embodiments are confined from both sides to allow gas, liquid, slurry and solid particles to flow through while keeping the embodiments confined in the heat transfer section 3. The round embodiments, like round balls, increase the heat transfer between the combustion gas, the liquid and slurry and thereby clean any solids build-up from the enclosure 10 walls.

Figure 4:
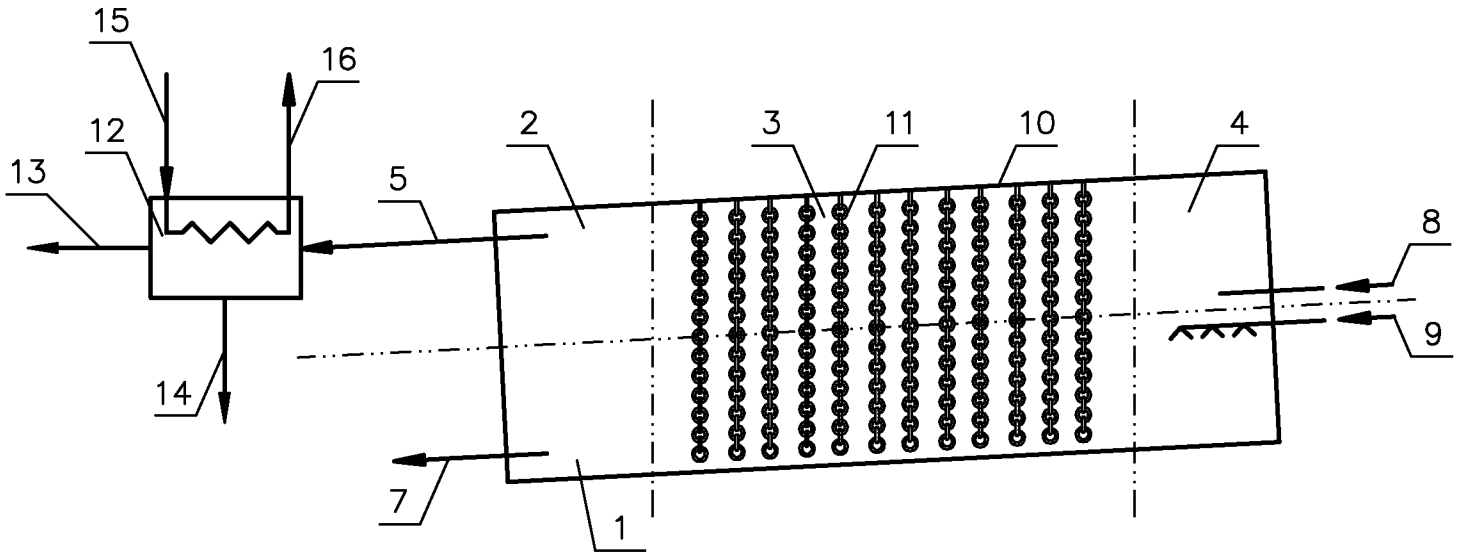
FIG. 4 describes steam generation with a heat exchanger at the discharged gas.
Figure 4A:
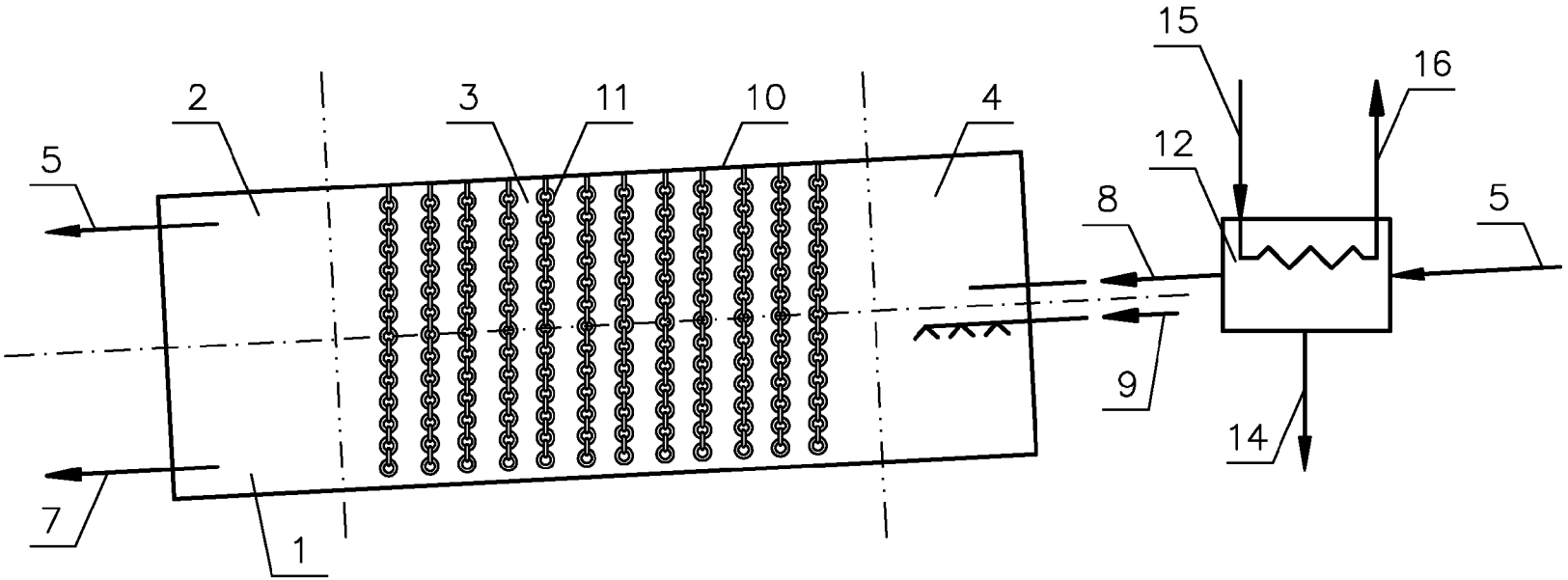

FIG. 4 describes the steam generation of FIG. 2, where the discharged gas 5, mainly steam and combustion gas, is flowing through a heat exchanger 12, where the heat is exchanged to a cold flow 15 to recover heat and condense the water 14. The cold non-condensing combustion gas 13 is released to the atmosphere or removed for further treatment. The condensed water 14 is used for steam generation or as a source of hot water for bitumen extraction. The heat is used for heating water for bitumen extraction, for steam generation or for any other usage.

Figure 5:
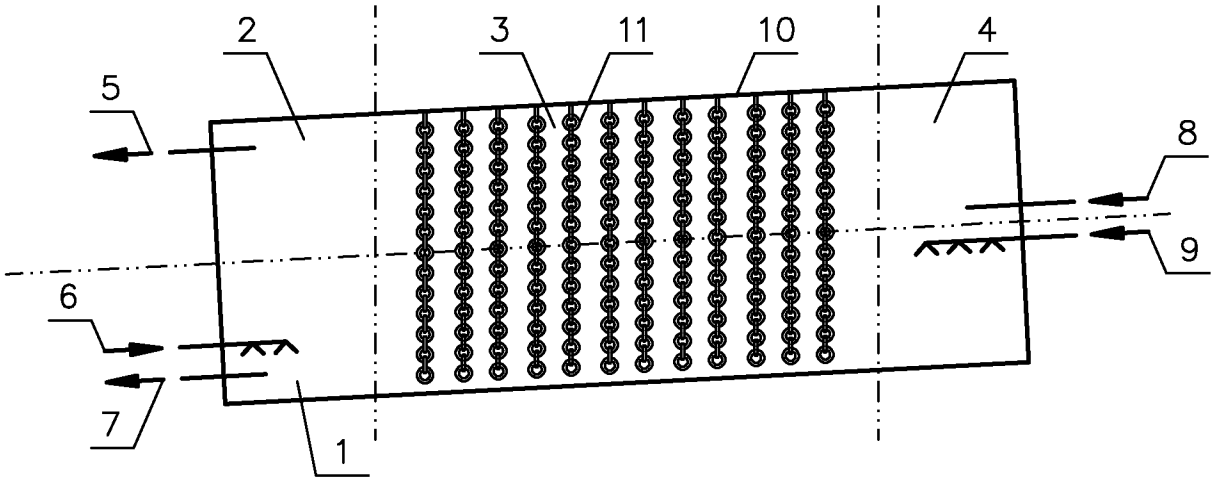
FIG. 5 shows a reaction chamber apparatus of a rotating steam generator that includes low quality water injection for mixture with the discharged solids to control their water/moisture content and the discharged temperature.

FIG. 5 shows a reaction chamber apparatus of a rotating steam generator that includes low water quality injection for mixture with the discharged solids to control their water/moisture content and to also control the water content, the generation of dust and the discharge temperature. The apparatus is a parallel flow apparatus, similar to the apparatus described in FIG. 2. The solids leaving section 3 of the enclosure are further mixed with low quality water or slurry 6. The slurry can be MFT, thickened MFT, or any other waste stream that includes water. The injection of liquid material near the solid discharge in section 2 has a few potential advantages. It can minimize the generated dust while better controlling the amount of water (in the form of moisture) in the discharged solids to produce discharged solids that can be easily trucked and used to support traffic. From the thermal perspective, the temperature of the discharged solids can be lower than the temperature of the discharged gas because of the mixture of the liquid, mainly with the solids and not so much with the produced steam and combustion gas, allowing a lower temperature for the discharged solids 7.

Figure 6:
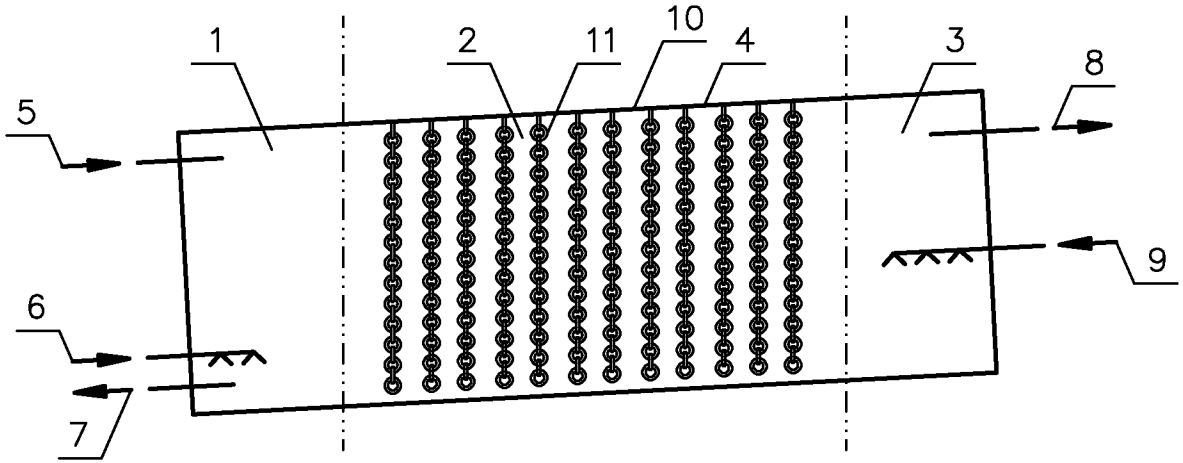
FIG. 6 is a counter flow direct contact steam generator with discharged solids or slurry water percentage control.

FIG. 6 is a counter flow direct contact steam generator with discharged solids or slurry water percentage control 7.

Energy 5, in the form of hot combustion gas, is injected into a pressure controlled enclosure 10. Another option is to inject the energy 5 in the form of a combustible mixture that includes carbon or hydrocarbon fuel and oxidizing gas for combusting internally inside section 1 in the rotating enclosure 10. The solids discharge is also located in the lower portion of section 1 of the enclosure. Additional low quality water, like MFT, lime softener slurry, or any other type of waste water, can be injected into section 1 as well to control the water content in the discharged solids and their temperature. Most of the low quality water 9 is injected at the higher point of the sloped rotating enclosure and is converted to steam and solids. The amount of water at the discharge can be controlled solely by controlling the amount of water 9. However, the discharged slurry or solid water content will be at a relatively high temperature and depend on many operation factors. Another option is to use a different source of low quality water 6 with a different chemical content, like high silica or chloride discharge water, which can affect the quality of the discharged gas 8 or create corrosion problems inside the enclosure 1.

Figure 7:
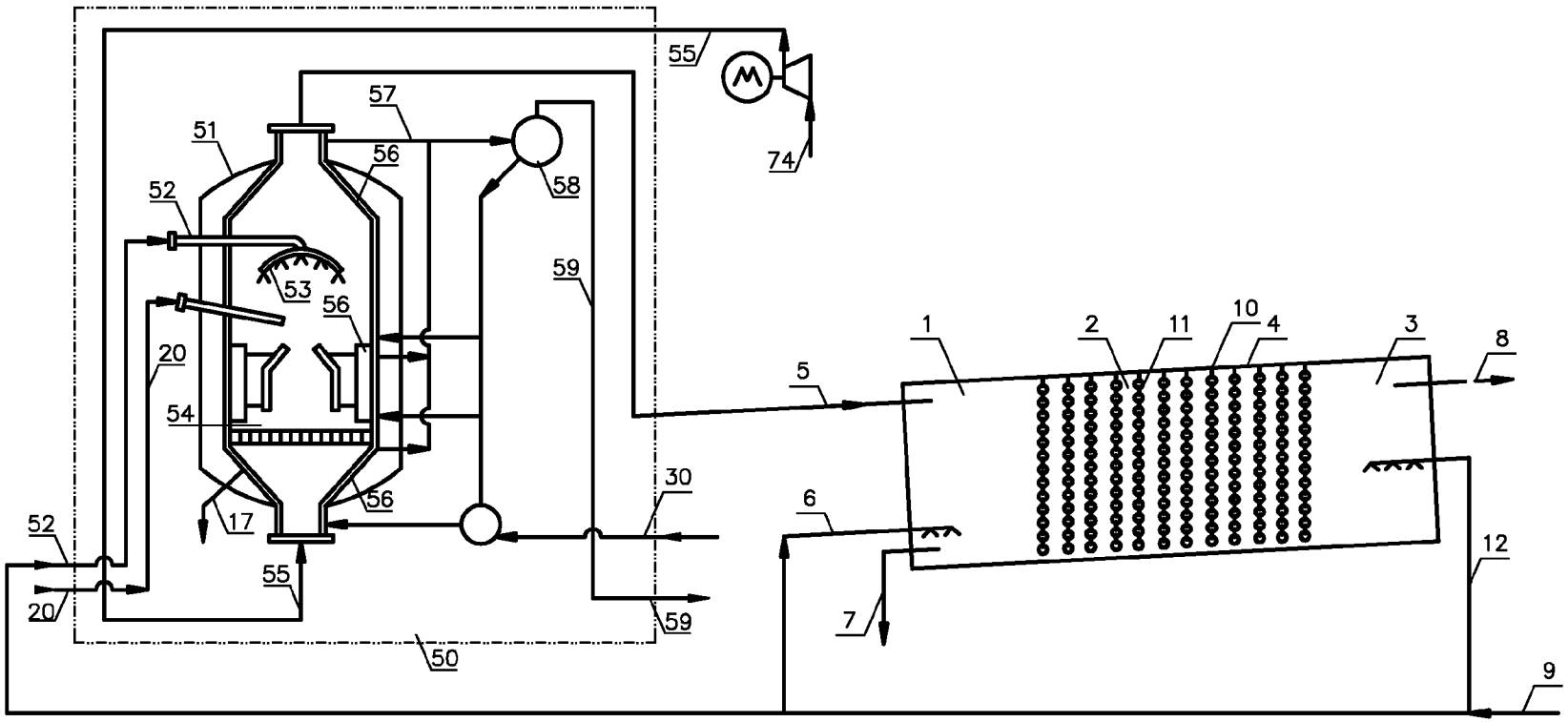
FIG. 7 is a combined fluidized bed combustion boiler and a direct contact steam generator with an in-direct internal heat exchanger for generation of high-pressure steam.

FIG. 7 is a combined fluidized bed combustion boiler and a direct contact steam generator with an indirect internal heat exchanger for generation of high-pressure steam. Fuel 20 is mixed with air 55 and injected into a Pressurized Fluidized-Bed Boiler 51. The fuel 20 can be any available low quality carbon or hydro carbon fuel in a pumpable form. This carbon or hydrocarbon fuel can include coal, petcoke, asphaltin or any other available fuel. Lime stone can be added to the fuel 20 or to the low quality water, like non-segregate fine tailings, 52 to remove acid gases like SOX. The Fluidized-Bed boiler can be a re-designed commercially available boiler modified with water injection 52 and with reduced capacity internal heat exchangers to recover less combustion heat. The reduction in the required capacity of the heat exchanger is because more combustion energy will be consumed, due to the direct heat exchange with possible water within the fuel (if water slurry fuel was used) and with the additional injected solid rich water 52, leaving less available heat to generate high pressure steam through the boiler heat exchangers 56. The boiler produces high-pressure steam 59 from distilled, demineralized feed water 30. There are several pressurized boiler designs that can be modified with direct water injection. (See Handbook of Fluidization and Fluid-Particle Systems by Wen-Ching Yang, Chapter 15—Applications for Gasifiers and Combustors by Richard A. Newby; paragraph 3.3.3 Coal Fueled PFBC). Examples of pressurized boilers are the Pressurized Internally Circulating Fluidized-bed Boiler (PICFB) developed by Ebara, (see paper No. FBC99-0031 Status of Pressurized Internally Circulating Fluidized-Bed Gasifier (PICFG) development Project dated May 16-19, 1999 and US RE37,300 E issued to Nagato et al on Jul. 31, 2001) and the Pressurized-Fluid-Bed-Combustion-Boiler (PFBC) developed by Babcock-Hitachi. Any other pressurized combustion boiler that can combust petcoke or coal and be simply modified with tailing injection (separate from the fuel) can be used as well. The importance in separating the low quality (like tailing) water injection into two flows is to combine the "boiler" section at the bottom, so that it is capable of efficiently combusting the low grade fuel at relatively high temperatures (typically more than 700 C, and usually in the range of 1000 C), with the DCSG above the combustion zone 53 that mixes additional low quality (like MFT) with the combustion gases to generate steam and solids, thus reducing the temperature to below the minimum temperature needed to support combustion and thus using additional heat to convert the low quality water 52 to steam and solids. The allowable temperature in the DCSG section can be lower than the combustion temperature, allowing for recovery of more combustion energy for direct contact steam generation. Another modification to a typical pressurized fluid bed boiler can be reducing the boiler combustion pressure, down to possibly 102 kpa (depends on the design process water temperature). A lower working pressure will reduce the plant TIC (Total Installed Cost) and the pumps and compressors' energy consumption. The use of the relatively low pressure system will have an impact on the process performance that has to be evaluated in detail in order to choose the optimal combustion and DCSG pressure. The generated steam 59 can be used for various purposes, like for injection into an underground formation for EOR, or it can be used in an open-mine oil processing area for flashing solvents and any excess steam can then be used for standard heating purposes. The combustion air 55 is injected at the bottom of the boiler to maintain the fluidized bed. High pressure 100% quality steam 59 is generated from distilled water 30 through heat exchange inside the boiler 56. Low quality water, like fine tailing water that contains organics, is sprayed at the upper section of the boiler 53 and mixed with the up-flowing combustion gases generated by the boiler. The liquids evaporate while steam and dry solids are generated. Small solid particles are carried with the up-flowing gas 5, and large solid particles fall to the fluidized bed by gravity. Dry solids 17 can also be discharged in intervals from the bottom of the pressurized boiler. The solids-rich combustion gases discharged from the boiler 61, flow to the rotating DCSG 10 as the energy source, as described in FIG. 5. The hot combustion gases 5 from the fluid bed boiler mix with the carry-on solid particles and steam generated by the evaporated injected water 52. In the rotating enclosure they are mixed with additional low quality water which is injected at the high end of the sloped rotating enclosure 10. The flow of the combustion gases 5 is a counter flow to the flow of the evaporated low quality water 12. However, parallel flow enclosures, as described in FIG. 2, can be used as well. The heat energy is transferred to the low quality water (or slurry) 12. To enhance the heat transfer in the rotating enclosure, chains can be added to section 4. The chains, in their wet section, can also help in reducing the amount of dust in the discharged gas 8. The solids are discharged at low point 7. The discharged solids 7 can be in a dry form or in a semi-solid slurry form that can be used for back-fill in a land-fill and to support traffic. For better control of the water content in the discharged solids, additional low quality water 6, like MFW, can be added.

Figure 8:
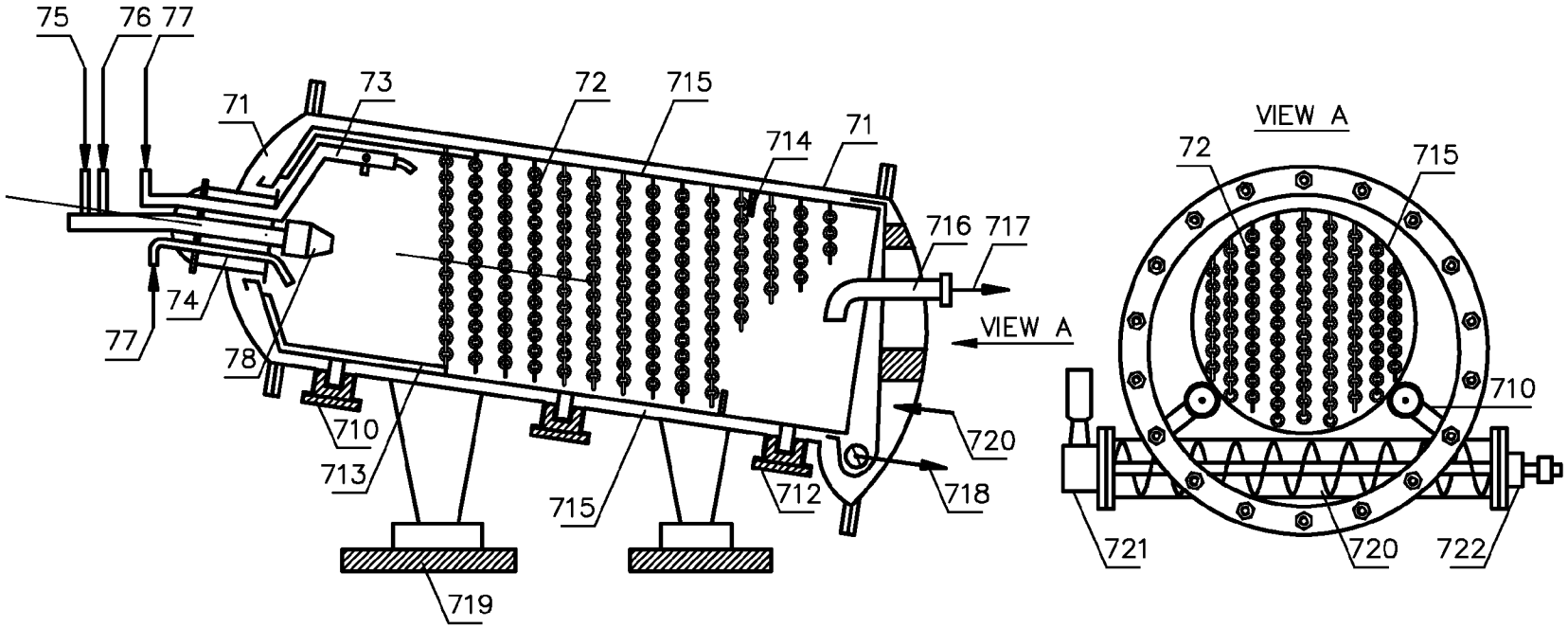
FIG. 8 is a schematic view of the rotating steam generation apparatus of the present invention.

FIG. 8 describes the rotating steam generation apparatus of the present invention. A pressurized sloped vessel 71 includes an internal combustion head at its high point. Fuel 75 and oxidizing gas 76 are injected through the combustion head 78 and combusted inside the pressurized sloped vessel. The vessel includes internal rotating enclosure 715 that includes chains 72 connected to the rotating enclosure in the Sloped vessel 71. Low quality water 77 is injected into and around the combustion reaction area 73 to control the combustion temperature and protect the combustion area structure section 74, while generating steam. Additional low quality water 77 is injected below the combustion head to prevent excessive reduction in the combustion temperatures as the temperature to support combustion is significantly higher than the temperature for the steam generation. The combustion area is insulated 713 to protect against the high temperatures. The heat transfer is enhanced by the use of chains 72 that are connected to the rotating enclosure 715. The chains also remove solid build-up deposits to keep the rotating vessel clean. The rotating vessel can include a partial separation 714 to enhance the heat exchange between the different phases. The steam and combustion gas 717 are discharged from the vessel discharge section 71 through pipe 716 which is located at the upper section of the low end of the sloped vessel. The internal rotating enclosure 715 is supported on rotating wheels 710. The solids are discharged through a screw 720 that collects the discharged solids falling by gravity from the low end of the rotating enclosure and then collected by the rotating screw where they are discharged through valve 721 to maintain the pressure. The solids are in a dry particle form or in a stable slurry form, a stackable non-flowable form. The discharge screw is located perpendicular to the rotating enclosure to collect the solids or the concentrated slurry. Because the solids or the slurry are not foldable, a perpendicular single or double screw can be used, where the rotating screw energy is used for mixing and mobilizing the solid particles. The apparatus includes a stationary pressure vessel 71 with internal rotating enclosure 715 to simplify the feed and discharge connections. However, it should be obvious to use a rotation seal for the connections and use a pressure controlled rotating vessel with swivels for the connections, at least at low and medium pressures of up to 15 bar.

Figure 9:
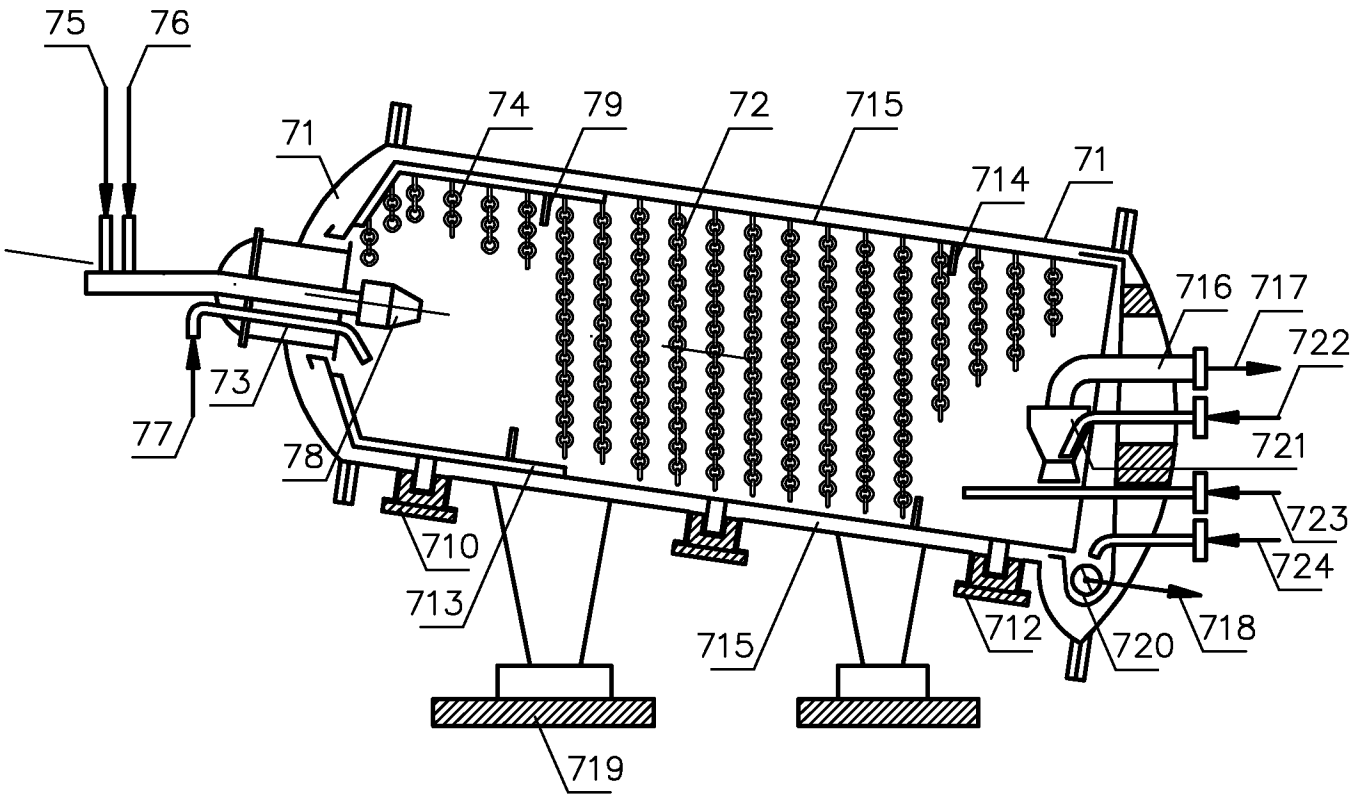
FIG. 9 is a schematic view of a parallel flow DCSG reactor, as described in FIG. 8, including additional features.

FIG. 9 is a parallel flow DCSG reactor as described in FIG. 8 but with a few additions. The combustion chamber includes chains where the low quality water, like oil sands MFT, is injected into the lower portion. The short chains in this area are made from high temperature resistance material, like high alloy steel, to withstand the combustion conditions and the rapid temperature changes. Due to the rotating movement, the chains in this section are cooled by contact with the liquid water continually supplied to the bottom of the rotating combustion chamber. The chains also help with removing slurry and solids build-up from themselves and from the enclosure walls. The discharged gas and steam 722 have an internal separation stage, to remove solid particles, by using an internal cyclone 721. The cyclone efficiency is enhanced by the use of recycled combustion gas 722 injected to its lower part. Addition low quality water, like MFT or lime softener sludge 723, can be injected into the chain section at the back of the sloped enclosure. This water can reduce the temperature of the discharged steam and combustion gas 717 and reduce the solid particle dust in the discharged gas flow. The generated solids 718 or stable slurry are removed from the bottom of the vessel through perpendicular screw 720. Additional low quality water, possibly with a controlled quantity of compressed air as an oxidizer gas, is used to transfer the calcium sulfite to calcium sulfate and to replace the combustion gases in the discharged solids 718. The liquid and possibly gas 724 injected closed to the screw at the solids low discharge point reduce the temperature of the discharged solids 718 with minimum impact on the temperature of the discharged gas and steam 717. They also do not reduce the dust in the discharged gas and steam 717 but only in the discharged solids 720 as they directly control the moisture content of the solids leaving the discharge screw 720. In comparison, the low quality water injected to the lower chain section 723 can reduce the dust in the discharged gas and steam 717, but they will also reduce the temperature at the discharge gas product 717. Another option is to inject solid powder, carried on pneumatically with compressed air as the injected fluid 724, thus mixing it with the DCSG solids from the evaporated low quality water 77 through the discharge screw 720 to increase the stability of the discharge solids with minimum impact on the produced gas and steam 717.

Figure 10:
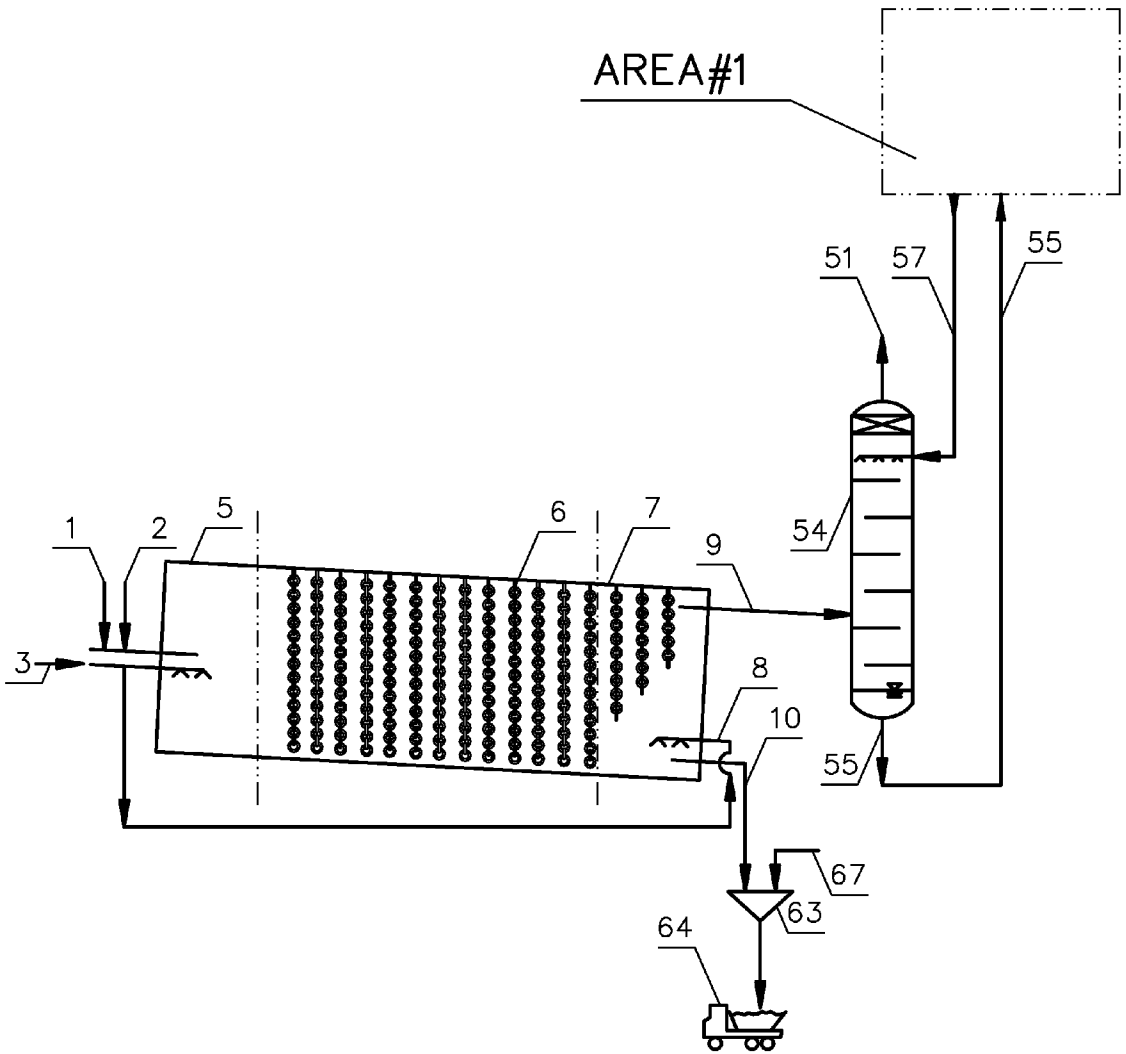
FIG. 10 is a schematic view of the present invention for the generation of hot water for oil sands mining extraction facilities or for pre-heating of water for EOR, with direct contact process water heating and Fine Tailing water recycling.

FIG. 10 is a schematic of the present invention for the generation of hot water for oil sands mining extraction facilities or for pre-heating of water for EOR, with direct contact process water heating and Fine Tailing water recycling. Area #1 includes a Prior Art commercial open mine oil sand plant. The plant consists of mining oil sand ore and mixing it with hot process water, typically at a temperature range of 70 C-90 C, separating the bitumen from the water, sand and fines, and discharging the water mixture to a tailing pond. The oil sand mine facility AREA #1 generates cold process water 57. The cold process water 57 is heated by direct contact with the steam and combustion gas 9 produced in the rotating enclosure 6. The steam and combustion gas can be supplied from an external source or from an internal fired fuel and oxidizer mixture. Energy is introduced at section 5, a high point of the sloped enclosure 6. The energy can be in the form of hot combustion gases generated by a separate unit like the pressurized boiler (not shown) or the mixture of fuel 1 and oxidizer 2 that are internally combusted inside section 5 of the enclosure. The fuel can be coal, petcoke, or hydrocarbons such as untreated heavy low quality crude oil, VR (vacuum residuals), asphaltin, and natural gas or any other available carbon or hydrocarbon fuel. The oxidizer is a gas (pure oxygen, air, or enriched air). The pressure inside the rotating drum is higher than 1 bar, preferably higher than 103 kpa. Another bi-product of the open mine oil sand plant, the FT or MFT 3, is supplied and mixed at pressurized rotating enclosure 6, where a mixture of steam is generated in a direct contact environment between the FT or MFT and the hot combustion gas. The rotating enclosure 6 is described in FIG. 5. Solids 10 are recovered from the enclosure in a form that is stable enough to support traffic, if used as back-fill. The combustion gas and steam mixture 9 is used to heat the process water 57. The generated hot process water 55 is at a temperature of 70 C-95 C. It includes the steam component from flow 9 that is exothermally condensed and washed into the down-flow cold process liquid water 57. The hot process water 55 is supplied to the oil sands facility AREA#1 where it is mixed (possibly after some treatment such as pH adjustments) with the mined oil sands ore. The NCG (Non Condensable Gases) 51 are released to the atmosphere or removed for further treatment. To better control the water content in the discharged solids, additional MFT can be added to the discharged solids 10. The discharged solids can be further mixed with air and possibly with additional dry sand 67. The air 67 can remove additional moisture. If limestone or softening sludge was used to remove sulfur from the fuel, the forced oxidation will consume additional water and convert the calcium sulfite to gypsum, as described in my previous Canadian application 2,686,140.

Figure 11:
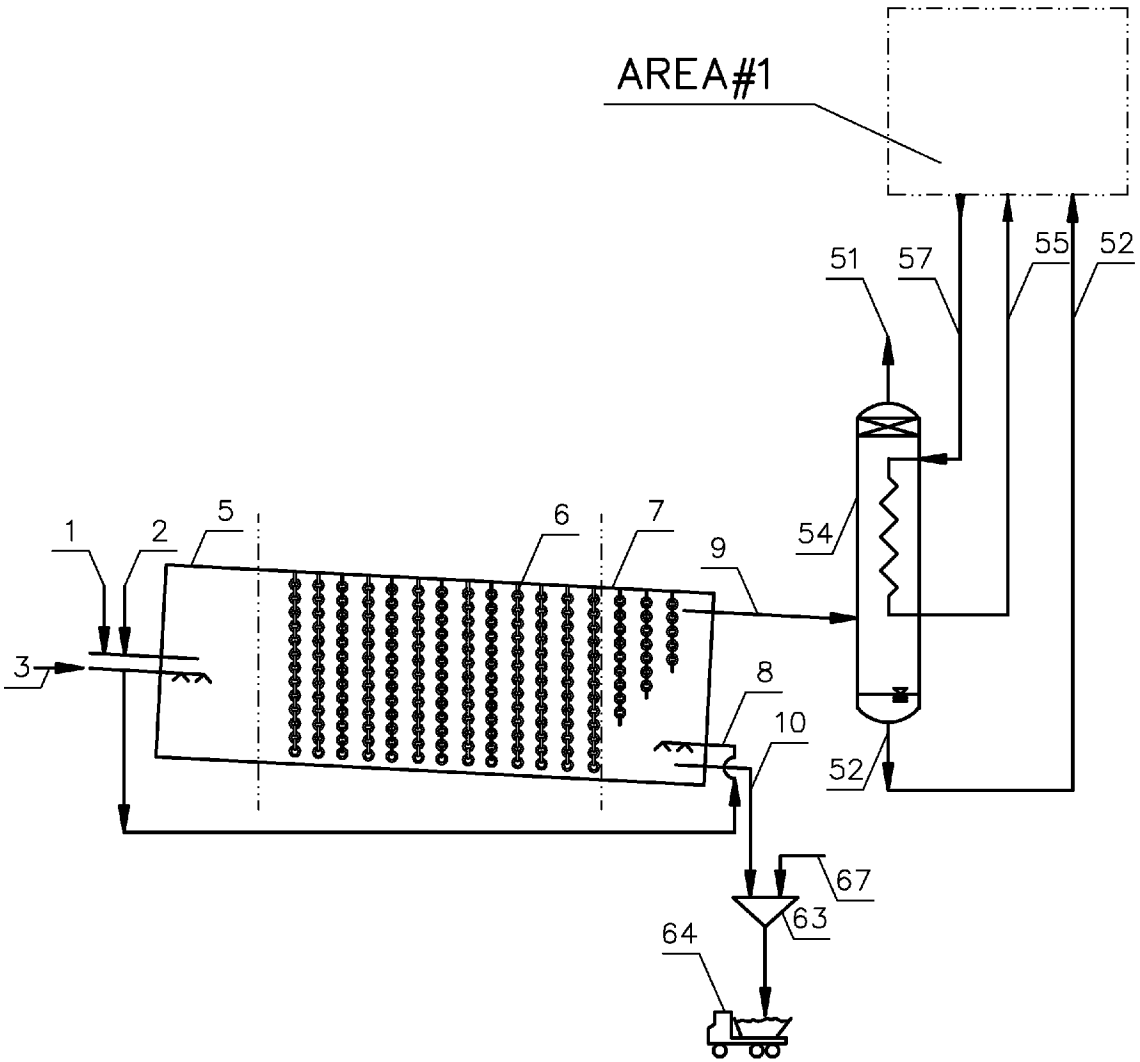
FIG. 11 is a schematic view of the present invention for the generation of hot water for oil sands mining extraction facilities or for pre-heating of water for EOR, with non-direct heat and water recovery.

FIG. 11 is a schematic of the present invention for the generation of hot water for oil sands mining extraction facilities or for pre-heating of water for EOR, with non-direct heat and water recovery. The difference between FIG. 11 and FIG. 10 is in the recovery of the heat and the water from the steam and gas 9 discharged from the DCSG rotating enclosure 6. Cold flow, like process water 57, recovers the heat from flow 9 through a heat exchanger located in vessel 54. The steam in flow 9 water condenses to water 52 during the heat exchange. The combustion NCG gas 51 is released to the atmosphere or removed for further treatment. The condensed water 52 is supplied to the oil sands plant AREA #1 where it can be treated further. The quality of the heated process water does not change due to the non-direct heating process because there is no mixture between the process water and the discharge gas 9 leaving the DCSG. This is an advantage if the water quality is critical (like in the case of using it without any additional treatment as de-mineralized BFW for EOR). The disadvantages are the significant heat transfer surface required for condensing the water in flow 9, the risk of solids build-up in the heat exchange surfaces, and the corrosion problem in the heat transfer due to the high concentration of CO2 and possibly other acidic gases like SOX and NOX within the condensing steam. Another characteristic is the generation of the condensed water in the bottom of vessel 54. The condensed water has a low pH, due to the CO2 and the acid gas remains in the combustion flow 9. It also includes solid particles that were carried on with the combustion gas and steam 9, and washed down with the condensing steam 52.

Figure 11A:
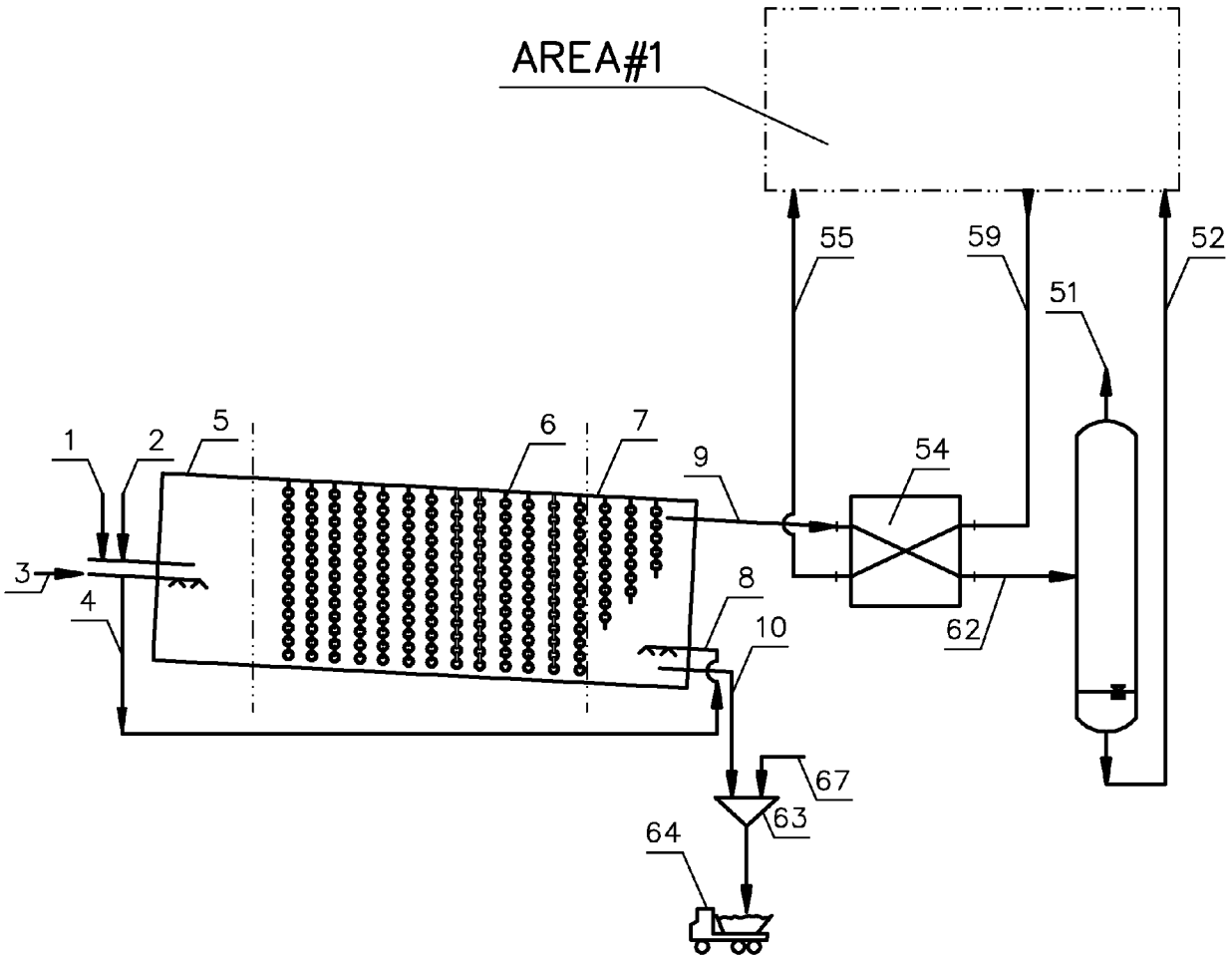
FIG. 11A is a schematic view of the present invention for the generation of hot water for oil sands mining extraction facilities or for pre-heating of water for EOR, with non-direct heat and water recovery.

FIG. 11A is a schematic of the present invention for the generation of hot water for oil sands mining extraction facilities or for pre-heating of water for EOR, with non-direct heat and water recovery. From the process perspective, FIG. 11A is similar to FIG. 11. The difference is in using two separate process units for the heat exchange and for the removal of the condensed water 52. The heat exchange is done using a non-direct heat exchanger 54. The two phase cold flow 62 flows to a separator vessel that separates the NCG and the heater 52. The heat recovered in the heat exchanger is used to heat the process water 59.

Figure 11B:
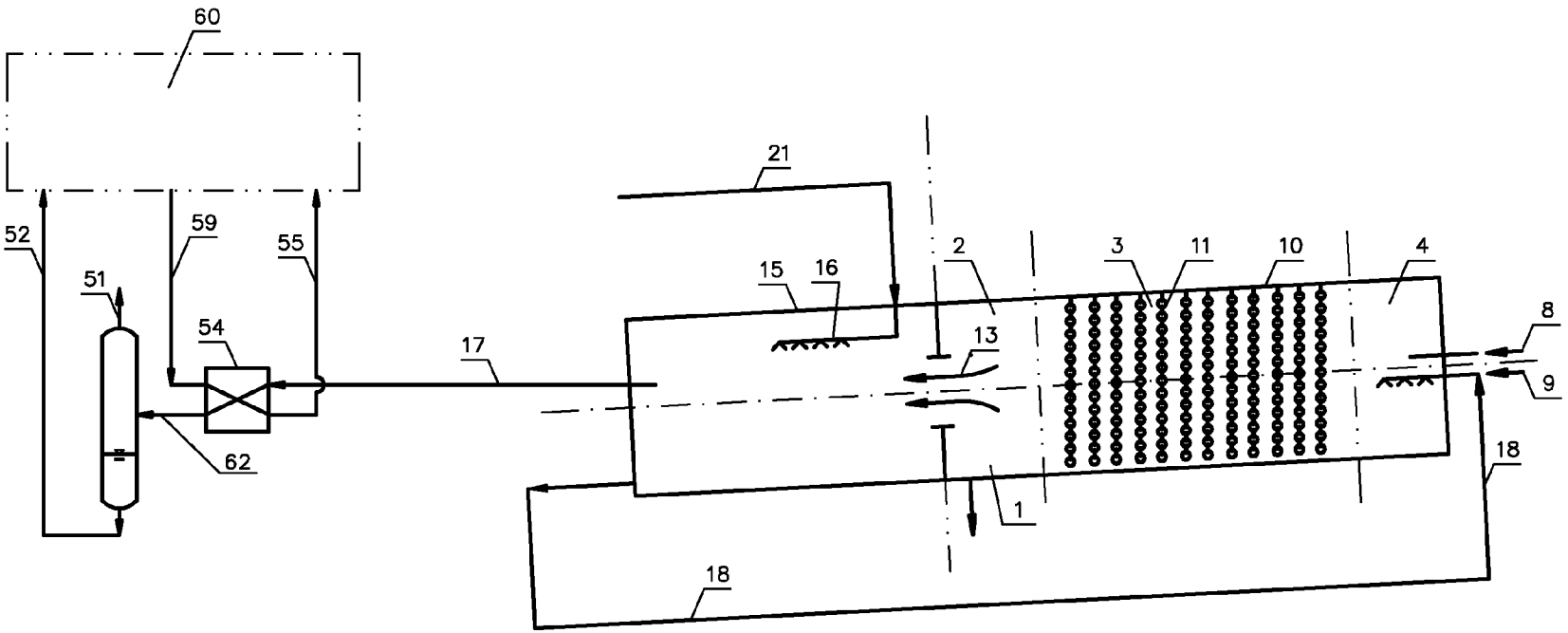

FIG. 11B is very similar to FIG. 11A with an integrated rotating wet scrubber for generating wet steam for the production of hot water for oil sands mining extraction facilities or for pre-heating of water for EOR, with non-direct heat and water recovery. Scrubbing water 21 is sprayed 16 into the scrubber rotating section 15 to remove solids that were carried-on with the gas stream 13 and possible contaminated gases. Section 15 can include elements to enhance the scrubbing and heat exchange between the liquid water and the gas like lifting means, solid particles or chains. Portions of the liquid water 21 that were not evaporated 18 with the solids are recycled back to the dry section of the direct contact steam generator where they transferred to steam and the solids are removed in a primarily dry form from section 1. The discharged gas stream 17 includes saturated steam and combustion gas after the solids were scrubbed, possibly with acid gas that can be removed as well with the use of chemicals like calcium or ammonia. The condensed water 52 will be cleaner and more ready to use by the oil sands plant 60.

Figure 12:
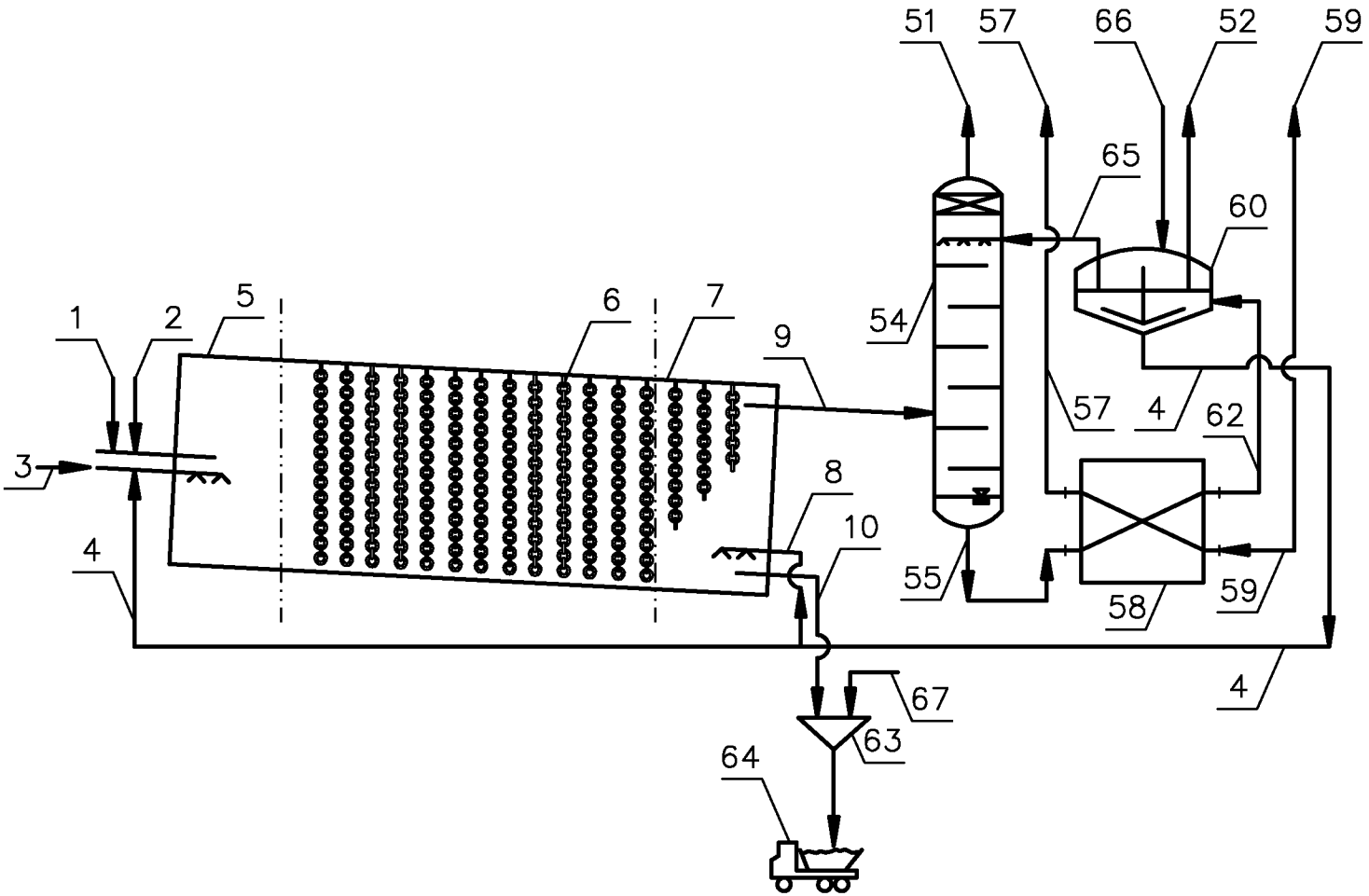
FIG. 12 is a schematic view, describing another embodiment of the present invention with parallel flow DCSG, and combined direct contact heat exchanger with the combustion gas and indirect contact heat exchanged between the process water and the condensed water.

FIG. 12 describes another embodiment of the present invention with parallel flow DCSG, and combined direct contact heat exchanger with the combustion gas and indirect contact heat exchanged between the process water and the condensed water. Fuel 1 and oxidizer 2 are injected into a pressurized rotating parallel flow DCSG and combusted in the combustion section 5. Fine Tailing water, together with solid rich recycled condensing water 4, is injected into the DCSG. The DCSG includes heat transfer section 6 with internal chains to improve the heat transfer and to remove internal solids deposits. The solids are removed from the DCSG in a solid or semi-solid form. Additional FT 8 can be provided to the solids before they are discharged. The FT can increase the water content of the solids to prevent dust and to allow the reaction of the calcium sulfite to produce calcium sulfate (gypsum). The amount of FT 8 is such that the solids are dry enough (after mixing with air for oxidation) to support traffic. If lime stone or possibly softening sludge was used to remove the SO2 from the combustion, the solids, with some FT 8, will be mixed 63 with air 67 to create an oxidation reaction of the calcium sulfite. This reaction will consume water, which will be supplied by adding additional FT 8 or MFT, and through this, will increase the amount of FT that is permanently removed. It will also create a stabilizing effect because of the crystal water affinity with the gypsum (to generate a hydrate molecule). The solids can be trucked 64 using the oil sand ore mine's existing equipment to then be used as back-fill in the ore excavation. The discharged gas 9 is injected into the scrubber and the direct contact heat exchanger 54. The hot combustion gas with the steam from the DCSG is mixed with the recycled cool condensing water 65. The steam is condensed to generate a hot water 55, typically in the range of 80 C-150 C, and any remaining solids from the DCSG are scrubbed by the liquid water. The hot condensate recycled water 55 flows through liquid-liquid heat exchanger 58 where the hot condensing water 55 leaving 54 indirectly heats the cold process water 59 supplied from the oil sand mine facility to generate the hot process water 57 used in the extraction oil sand mine facility or for EOR steam generation. The cooled condensing water 62 is separated in separator 60. Alkali material like lime stone slurry, possibly with WLS (Warm Lime Softener) sludge 66, is added to the recycled condensed water. The solid rich condensed water that includes solids that were carried by flow 9 leaving the DCSG, the alkali material that reacted with the SO2 and generated calcium sulfite, and possibly other solids (if, for example, Dolomite was present) are separated at separator 60. The solids rich flow 4 is recycled back to the DCSG. The access condensate water 52 is supplied to the Oilsands mine facility, where it can be further treated before being added to the process water, or it can be added directly to the cold process water 59.

Figure 13:
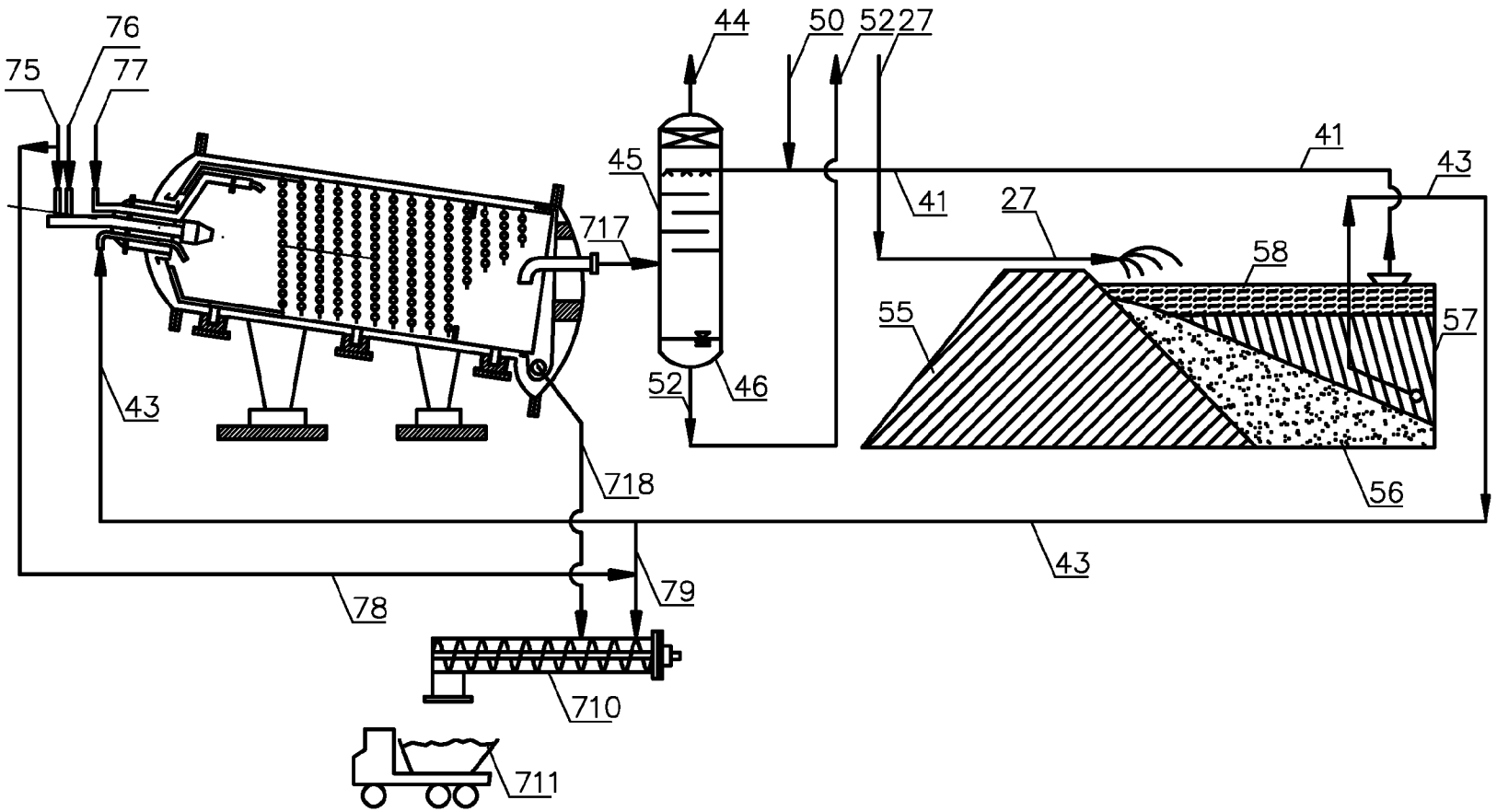
FIG. 13 shows a schematic view of the integration of a parallel flow DCSG with a direct contact process water heater and with solid discharge force oxidation.

FIG. 13 shows the integration of a parallel flow DCSG with a direct contact process water heater and with solid discharge force oxidation. Fuel 76, like petcoke, that includes high levels of sulfur, is injected with oxidizing air 75 into a parallel flow DCSG as described in FIG. 8. Low quality water that can include large a percentage of organics 77 is injected into the DCSG. MFT 43 is also injected into the DCSG. The DCSG includes the Direct Contact heat transfer section, with chains that improve the heat transfer and break solid deposits inside the reactor. The DCSG pressure is in the range of 102 kpa-5, 000 kpa. The solids are discharged by a screw as a semi-solid, concentrated material. Lime Stone is added to the DCSG water feed (77 and 43) to react with the generated SO2. The generated Calcium Sulfite will be forced to oxidize with air 78 and water to generate gypsum at mixer 710. Possible mixer types that can be used were mentioned in FIG. 11. A screw conveyor 710 with air supply 78 can be used as well. If required, more water can be added in the form of MFT 43. The discharged solids will be stable enough to support traffic. The combustion gas and steam 717 will be mixed in direct contact heat exchange with the process water, which can be supplied from the tailing pond 41 or from the operating oil sand facility 50. The hot process water, that includes the condensed water from the MFT, is supplied to the oil sand plant for mixing with the oil sand ore.

Figure 14:
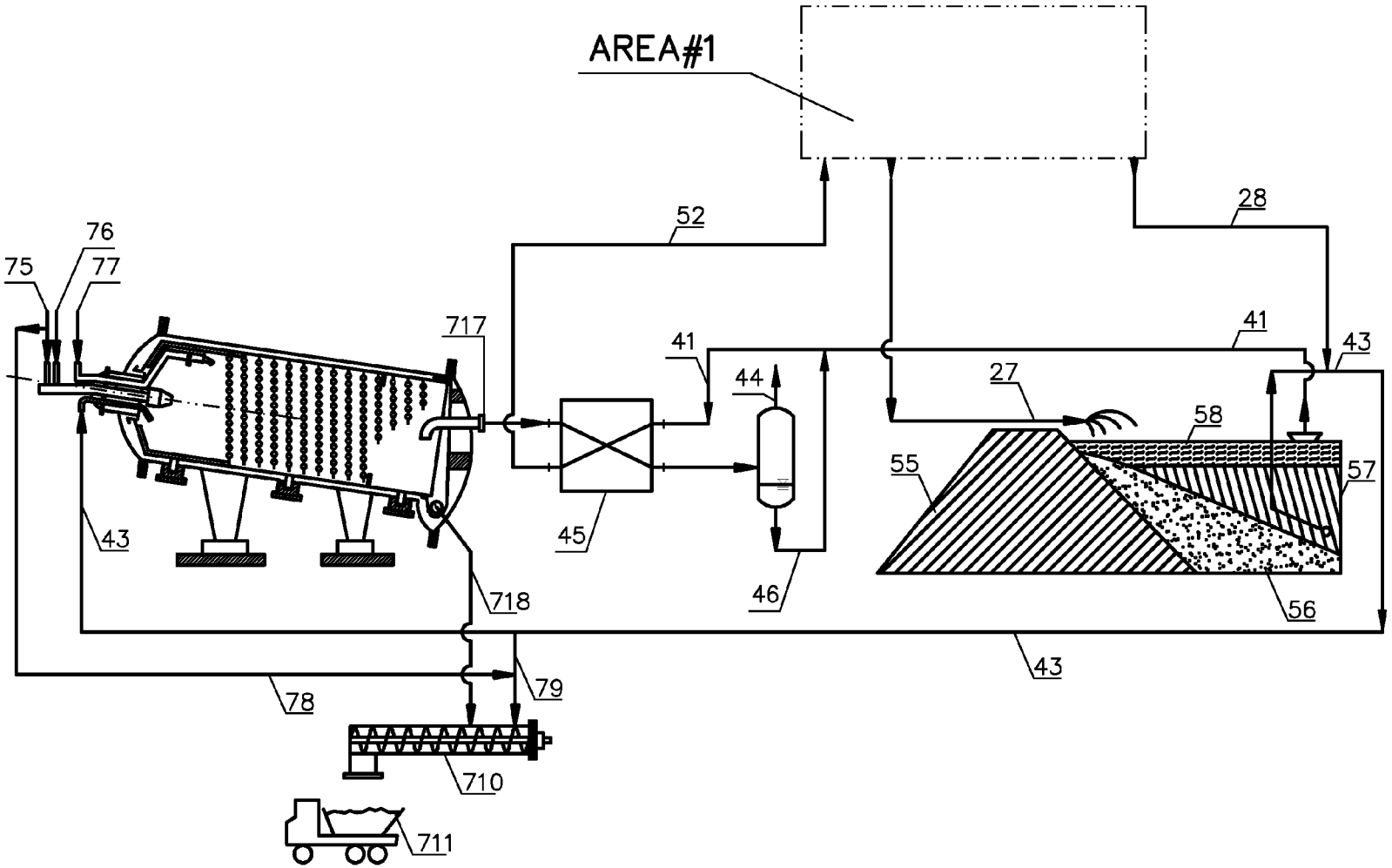
FIG. 14 shows a schematic view of the integration of a parallel flow DCSG with a non-direct contact process water heater using solid discharge force oxidation.

FIG. 14 shows the integration of a parallel flow DCSG with a non-direct contact process water heater and with solid discharge force oxidation. FIG. 14 is similar to FIG. 13 with differences in the recovery of the heat and the condensed water from the steam and combustion gas discharge flow 717. The heat is recovered indirectly through gas-liquid heat exchanger/condenser 45, where the condensed water separates from the NCG 44 through a knock-out vessel. The condensed water 46, that include solids and combustion gas tracers, can be sent back to the tailing pond, especially if their contamination level and acidity is high (not shown) as the tailing pond light acidity can accelerate the settling time. If their quality is accepted to mix with the ore, they can be used as hot process water and be mixed with the ore, they can be added to the process water 41, or they can be sent directly to the oil sand mine facility in AREA 1 for any use, such as being mixed with the thickeners water feed, if thickeners are used.

Figure 15:
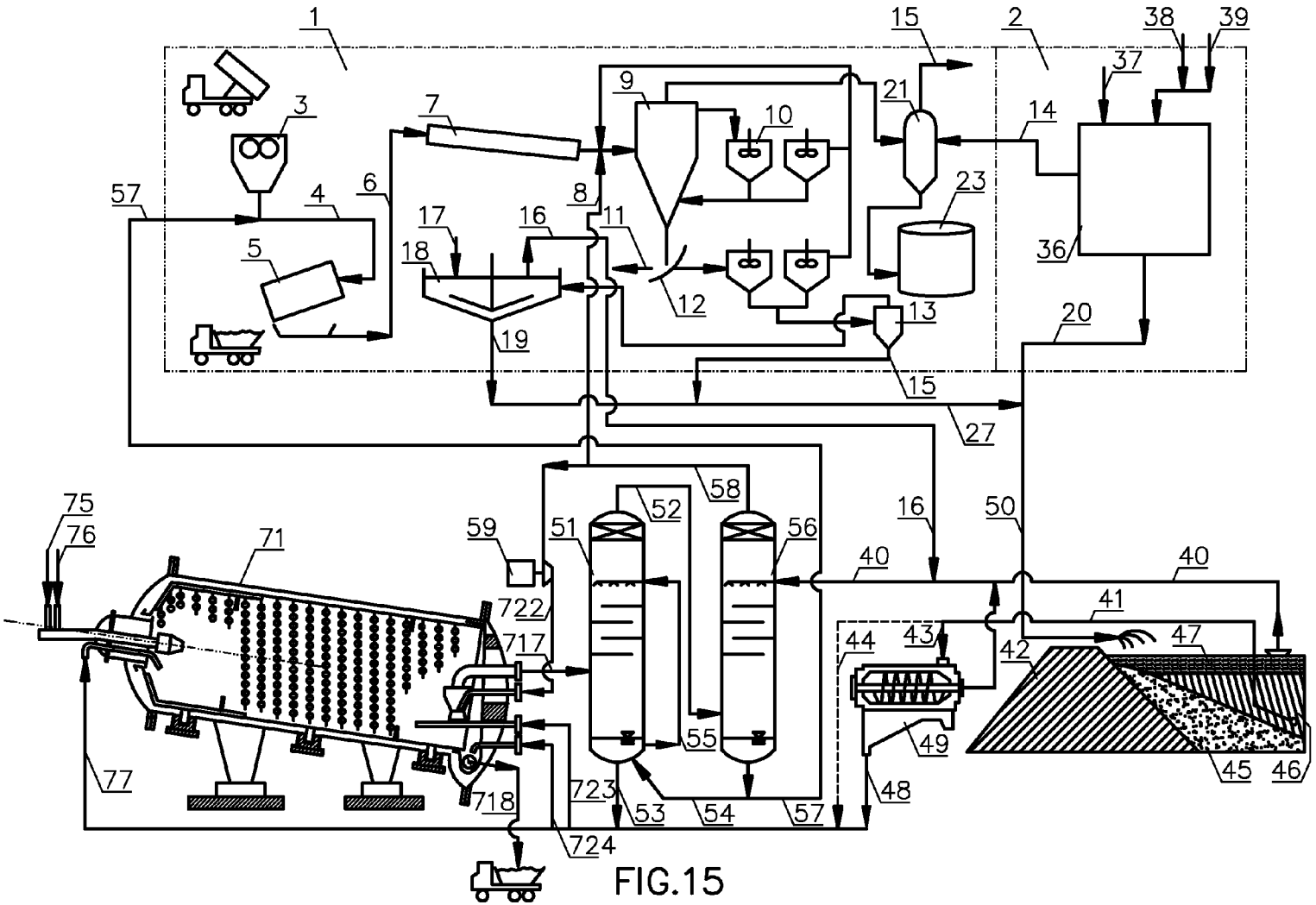
FIG. 15 is a schematic view of the integration of a parallel flow DCSG with open mine extraction plant.

FIG. 15 is a schematic of the present invention with a parallel flow DCSG. A typical mine and extraction facility is briefly described in Block diagrams 1 and 2 (See "Past, Present and Future Tailings, Tailing Experience at Albian Sands Energy" presentation by Jonathan Matthews from Shell Canada Energy on Dec. 8, 2008 at the International Oil Sands Tailings Conference in Edmonton, Alberta). Mined Oil sand feed is transferred in trucks to an ore preparation facility, where it is crushed in a semi-mobile crusher 3. It is also mixed with hot water 57 in a rotary breaker 5. Oversized particles are rejected and removed to a landfill. The ore mix goes through slurry conditioning, where it is pumped through a special pipeline 7. Chemicals and air are added to the ore slurry 8. In the invention, the NCGs (Non Condensed Gas) 58 that are released under pressure from tower 56 can replace some of the injected air at 8 to generate aerated slurry flow, or its compression energy can be recovered (by an expander) to compress air that can be used at 8. The conditioned aerated slurry flow is fed into the bitumen extraction facility, where it is injected into a Primary Separation Cell 9. To improve the separation, the slurry is recycled through floatation cells 10. Oversized particles are removed through a screen 12 at the bottom of the separation cell. From the flotation cells, the coarse and fine tailings are separated in separator 13. The fine tailings flow to thickener 18. To improve the separation in the thickener, a flocculant is added 17. Recycled water 16 is recovered from the thickener and fine tailings are removed from the bottom of thickener 18. The froth is removed from the Primary Separation Cell 9 to vessel 21. In this vessel, steam 14 is injected to remove air and gas from the froth. The recovered froth is maintained in a Froth Storage Tank 23. The steam can be produced in a standard high pressure steam boiler, in a OTSG, or in a COGEN plant or any other steam generation facility 36 using the elevated temperature in a gas turbine tail (not shown). The boiler consumes fuel gas 38 and air 39. The coarse tailings 15 and the fine tailings 19 are removed and sent to the tailing pond 50. Cold process water is recovered from the tailing pond 40. For its operation, the plant mainly consumes the process water after it has been heated-up to 70 C-90 C. The tailings 50 include a portion of stable FT (Fine Tailings) that will be pumped out from the deep locations of the tailing pond. Fuel 76 and oxidation gas 75 are injected into a vertical parallel flow DCSG 71, previously described in FIG. 9. FT 77 is injected into the DCSG. Chains are used to improve the heat transfer and to remove solids deposits. FT can be injected into the DCSG near the discharge side. FT flows 723 and 724 are injected in order to control the discharge temperature, for dust control, and to exactly control the moisture content of the solids discharge. The solids 718 can be removed from the system using a single or double extruder type screw design or any other controlled way that can mobilize the stable solids. The removed solids are trucked out to be used as Back-fill and to support traffic. The DCSG 71 can also include a solid removal cyclone on the steam and combustion gas discharge 717. The discharged gas is washed in vessel 51 to remove SOx, NOx, and any solid remains. Make-up water 54 is continually added to vessel 51, possibly with an alkali chemical like Lime stone slurry to remove the SO2. The generated solids, with the lime stone remains that didn't react with the SO2, are recycled back to the DCSG, together with the FT, where they can complete their reaction with the SO2. The make-up water is taken from the hot process water 57. The solids free and SO2 free (traces levels of sulfur oxides will remain even after the two stages of SO2 removal in the DCSG 71 and in the scrubber 51) saturated gas flow 52 will flow to vessel 56 (a counter flow direct contact heat exchanger between the cold process water 40 that is spread at the top of the vessel and the up-flow saturated steam and combustion gas 52). The saturated steam (from the FT) condenses with the process water. The hot process water 57 is supplied back to the oil sand extraction plant. The temperature of the discharged hot water 57 is between 70 C and 95 C, typically in the 80 C-90 C range. The hot water is supplied to the ore preparation facility. The cold process water is recovered from thickener 16 and from the top level of the tailing pond 40. Additional make-up water is pumped from any available resource, typically from the Athabasca River (not shown). The MFT are pumped from the bottom of the tailing pond 46. It can be further concentrated using a centrifuge 49 or thickener (not shown). The clean water separated from the MFT is added to the process water and the solid rich discharge 48 is fed to the DCSG 71. The generated dry solids are a "water starving" dry material. As such, they are effective in the process of drying additional MFT (Mature Fine Tailing) 724, to generate trafficable solid material without relying on weather conditions to evaporate excess water. The water affinity of the dry solid composite released from the DCSG 71 is dependent on its composition and particle size. The most effective water affinity material is a solid that, with the presence of water, creates crystals with water molecules (also called hydration). Gypsum (that contains calcium sulfite and calcium sulfate) belongs to this group of materials. If a highly sulfurous material fuel is used in the DCSG (like petcoke), lime can be added to remove the SO2 and generate gypsum. The gypsum will lose its crystal water when it is subjected to the high temperatures inside the DCSG, as its water will be converted to steam. Some tailing water might naturally contain additional minerals (in addition to the generated gypsum) that belong to this group of materials. Such minerals can include calcium silicate, calcium aluminate, and kaolin. When subjected to heat, the kaolin will naturally release its crystal water in the form of steam and be transformed into metakaoline. This hydration water affinity will improve the ability of the dry discharged solids to solidify MFT slurry to a stage where it is stackable and can carry traffic 718.

Figure 15A:
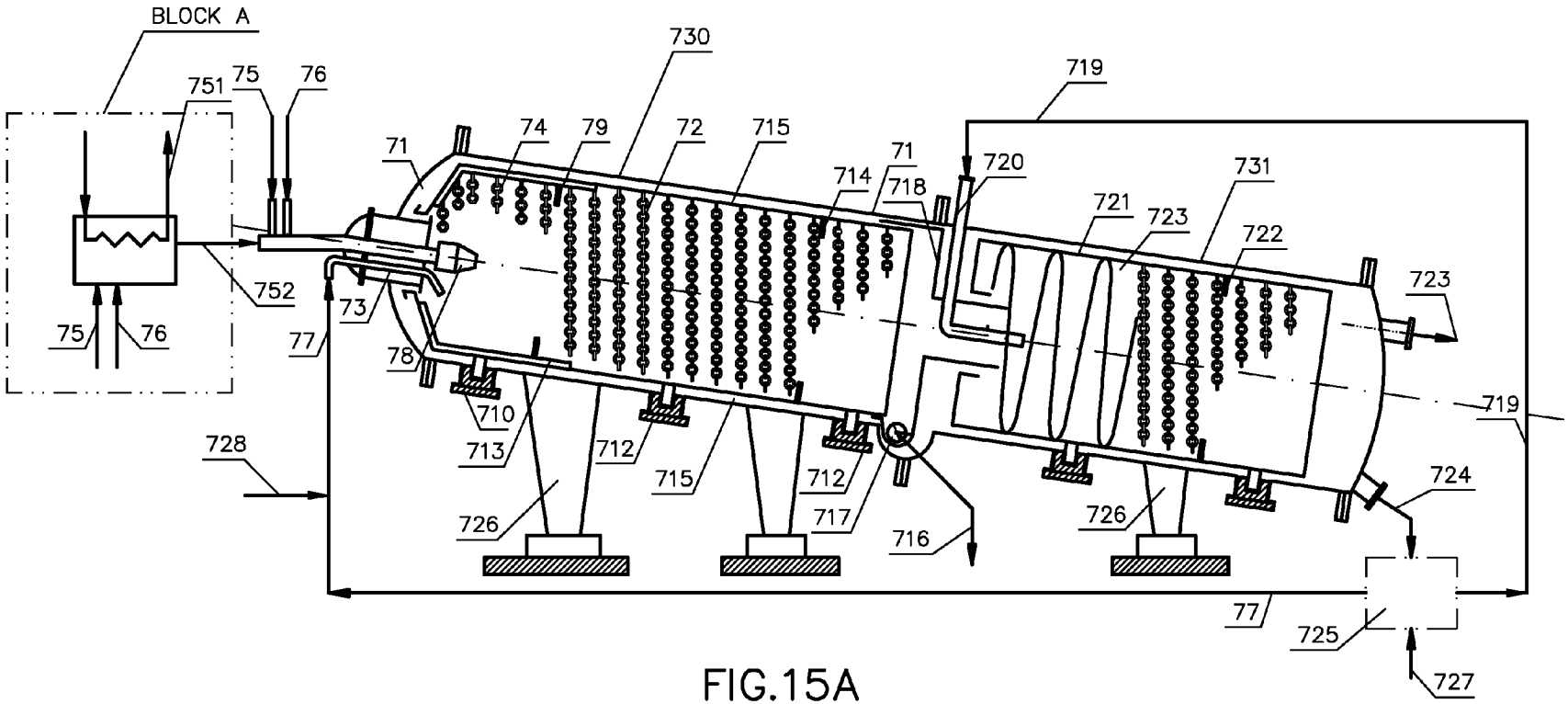
FIG. 15A is a combined dry and wet DCSG that for generating solids free saturated steam and combustion gas mixture and a stable solid waste that can be efficiently disposed of in a land fill.

FIG. 15A is a combined dry and wet DCSG for generating a solids free saturated steam and combustion gas mixture and a stable solid waste that can be efficiently disposed of in a land fill. The energy source to operate the DCSG can be supplied from external combustion unit, as described in BLOCK A, where carbon or hydrocarbon fuel 75 and oxidizer gas, like oxygen or air 76, are combusted at a controllable pressure. Some of the combustion energy can be recovered through a heat exchanger for generating steam 75. The hot combustion gases are injected to the dry section of the DCSG 78. Another option is to combust the fuel 75 and the oxidizer gas 76 internally inside the rotating DCSG. Water with contaminates 77 is injected and mixed with the combustion gas. To enhance the heat transfer, chains 72 are used. Other means can be used as well like, solid bodies, spirals 723 and lifting means, like scoops, to lift the liquids and solids into the stream of the combustion gas. The amount of water is controlled to generate stable solid waste 716 that can be discharged using screw or by any other means. The gas flow, mainly dry steam and combustion gas is discharged into a wet rotating scrubber that also generates saturated (wet) steam and combustion gas mixture. To increase the mixture this scrubber can have a spiral 723 to mobilize the water and the solids and mix them with the gas stream. It can also include chains to improve the mixture and the heat transfer or lifting means like scopes to enhance the mixture. Partial partitions 722 can be used as well to maintain the liquid water level to improve the mixture and increase the holding time inside the wet scrubber. The liquid water, at a temperature close to the saturated temperature, with the scrubbed contaminates and solids 724 is processed at 725 to produce solid rich stream 77 that will be fed to the dry DCSG 73 where most of the liquid water will be converted to steam and the solids will be removed in a dry form and a solids lean stream 719 will be recycled to the wet DCSG and used to generate saturated steam and scrub the gas flow. Make up water 727 is added to replace the water that was converted to steam. The make-up water can be water from any available source like fine tailings, brine, brackish water, municipal waste water etc'. The produced clean saturated steam and combustion gas 723 are discharged for further use by the oil production facility.

Figure 16:
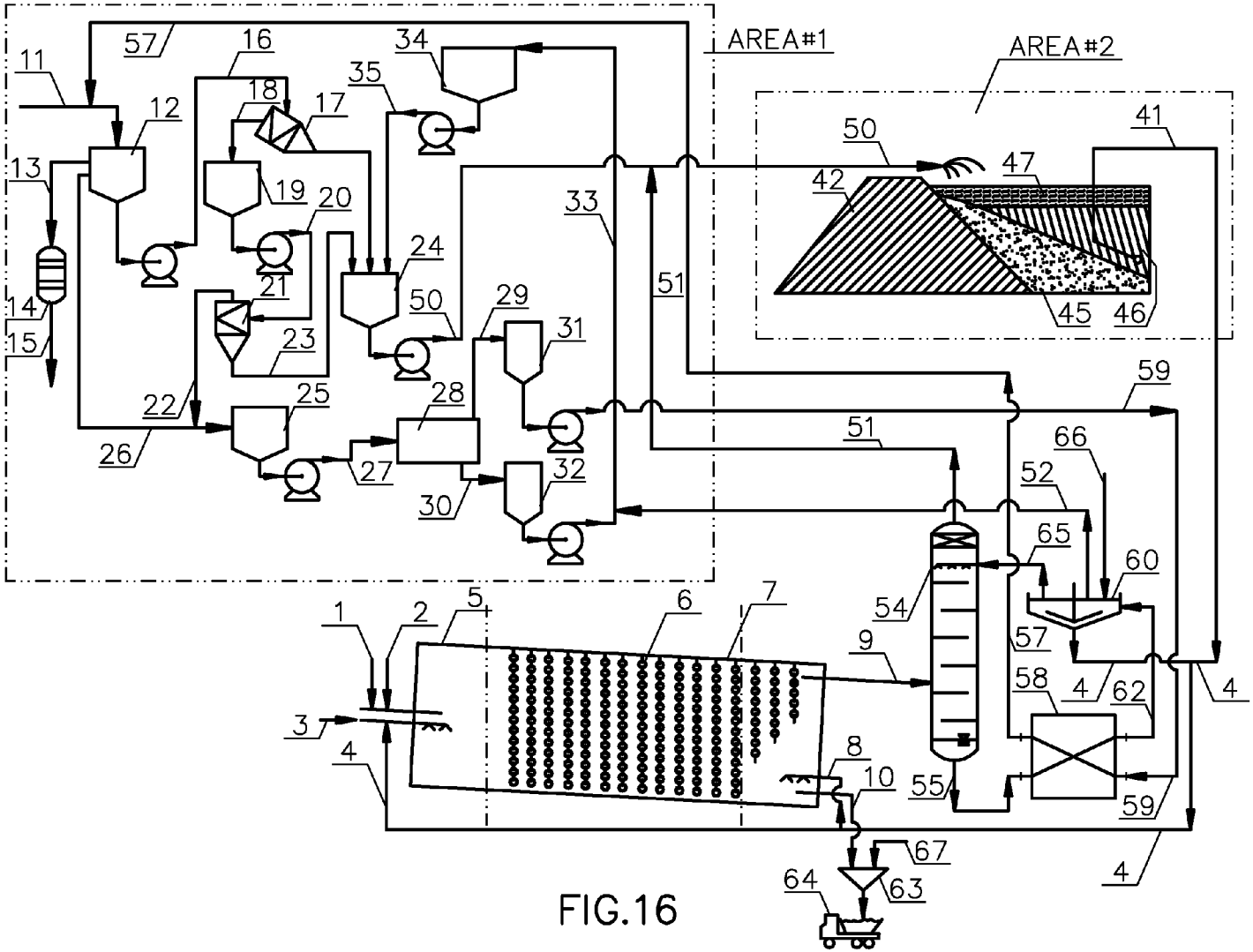
FIG. 16 is a schematic view of the integration of the DCSG rotating enclosure with an oil sands open mine facility.

FIG. 16 is a schematic of the integration of the DCSG rotating enclosure with an oil sands open mine facility. AREA 1 includes a prior art extraction facility. (See "Non Segregating Tailings at the Horizon Oil Sands Project" presented by Canadian Natural Resources Limited on December 2008 at the International Oil Sands Tailings Conference in Edmonton, Alberta). Hot water 57 is mixed with oil sand ore (not shown) and hydro transported 11 to PSC (Primary Separation cell) 12. Bitumen Froth is separated from the PSC and after deaeration 14, is supplied to the Froth treatment facility (not shown). The water, solids, and bitumen remains are pumped from the bottom of the PSC and directed to the first stage cyclones 17. The water and solids are discharged from the cyclone bottom and directed to NST (Non Segregating Tailing) pump box 24. The water, with some bitumen, flows to the second stage cyclone feed pump box 19 and from there, to the second stage cyclones 21. The water and solids from the second stage cyclones are directed to the NST pump box. Water, with bitumen recovered from the second cyclone top 22, together with water, bitumen and solids recovered from the middle of the PSC 26, is directed to a flotation feed pump box and into flotation cells 28. From the flotation cells, the bitumen is recovered and recycled back to the PSC and the tailings are recovered and directed to a thickener 34. Process water is recovered from the thickener for reuse. The recovered process water 59, possibly with make-up water from other sources, and recycled water from the tailing pond (not shown), are directed to a heat exchanger where the water is heated, using the heat recovered from the DCSG gas discharge. The system is described in FIG. 3A. However, any other configuration, as described in FIG. 2A-D, with an internally fired DCSG 6 or external PFBC connected to DCSG (not shown), can be used as well. The condensate 52 from the MFT and that was gasified in the DCSG 4, is recovered and directed to the thickener 34. Any acidity or solids are diluted and removed in the thickener, and eventually recovered and recycled back as process water. The cold NCG combustion gas, after the steam and the water are recovered, is mixed with the NST (Non Segregating Tailings) to reduce the low pH occurring due to the high content of $CO_2$.

Figure 17:
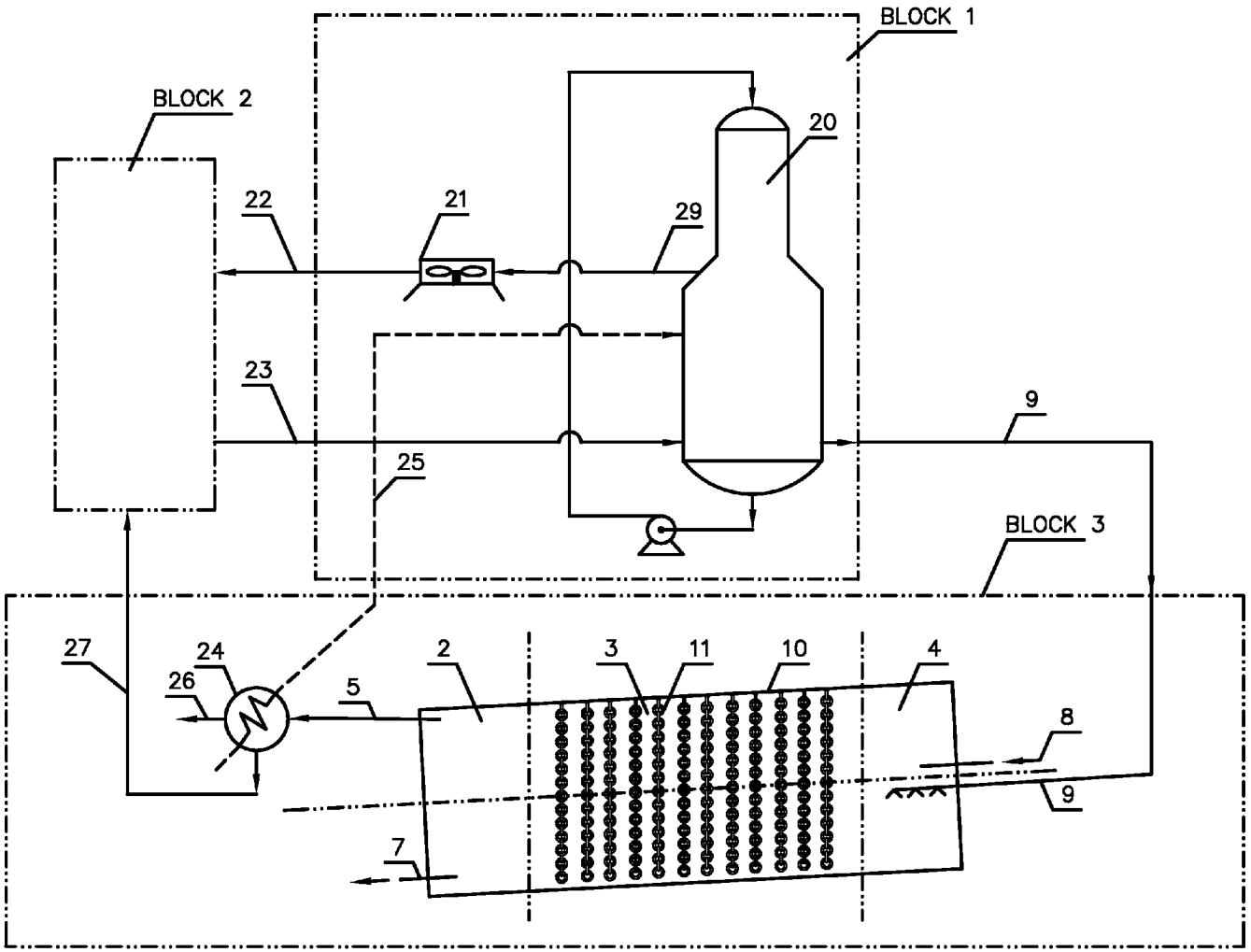
FIG. 17 is a schematic view, describing the use of a parallel flow rotating DCSG combined with evaporator.

FIG. 17 describes the use of a parallel flow rotating DCSG combined with an evaporator. BLOCK 3 includes a ZLD rotating reactor 10 as described in FIG. 2. Any other type of DCSG, like the counter flow rotating enclosure or fluidized bed, can be used as well. The heat energy to operate the system can be from the internal combustion of carbon or hydrocarbon fuel or from an external source of pressurized combustion that feeds the hot flu gas 8 to the rotating enclosure (not shown). The solids 7 are removed from enclosure 10 in a stackable form where they can be effectively disposed of in a land-fill. The discharge gas, composed of steam and combustion gas 5, can be at a temperature of 100 C-400 C. The pressure can vary from 102 kpa to 20000 kpa. Heat 25 is recovered from the discharge gas 5. There are commercially available methods to recover the heat, like the use of a non-direct contact heat exchange 24 as described in FIGS. 4 and 11. Another option is to use a direct contact heat exchanger to recover the heat directly to water under a controllable pressure as described in FIG. 10 or using a combined method, as described in FIG. 12. The heat can be in any form, like heated pressurized water or heated gas, like steam. After the heat is recovered, the steam in discharge flow 5 condenses to water 27 and NCG 26. The condensed water can be used in BLOCK 2, after treatment, for steam generation. BLOCK 2 can include an EOR plant that include different areas like a water treatment facility to treat the produced water, a steam generation facility injection and production wells and other typical auxiliaries. Any commercially available water treatment plant and steam generation facility can be used. BLOCK 2 generates a discharge water stream. Typically, with an OTSG steam generation facility, the discharge water is the blow down water after extracting the low pressure steam. This blow-down is typically disposed of in a disposal well, or if a disposal well is not available in an evaporator and crystallizer. Another source of disposal water can be the discharge streams from the water treatment plant, like lime sludge, filters backwash etc'. The evaporator 20 can be a vertical falling film type evaporator, as shown schematically. A few evaporators can installed together, one after the other to increase capacity and efficiency. Any commercially available evaporator can be used. The water feed 23 to the evaporator can be the blow down from the steam plant. The evaporator can use low pressure steam or heat from flow 5 as the heat source use for evaporation. The water vapor condenses with the use of air coolers 21. To increase the thermal efficiency, a heat exchanger can be used between the hot vapors flow 29 and the feed water 23 to recover the vapor heat (not shown). Any other high efficiency commercially available evaporation and condensing arrangement can be used as well for the system in BLOCK 1. The concentrate brine from the evaporator 9 is directed to the enclosure 10 in Block 3 as previously described. The water from brine 9 is evaporated under the high temperature inside the enclosure 10, and the solids carried on with the water are recovered in a dry-stackable form from the low end of enclosure 10, where they can be removed in a dry form to achieve an overall ZLD (Zero Liquid Discharge) facility. BLOCK 3 can include any of the DCSG described in FIG. 3 to FIG. 12.

Figure 17A:
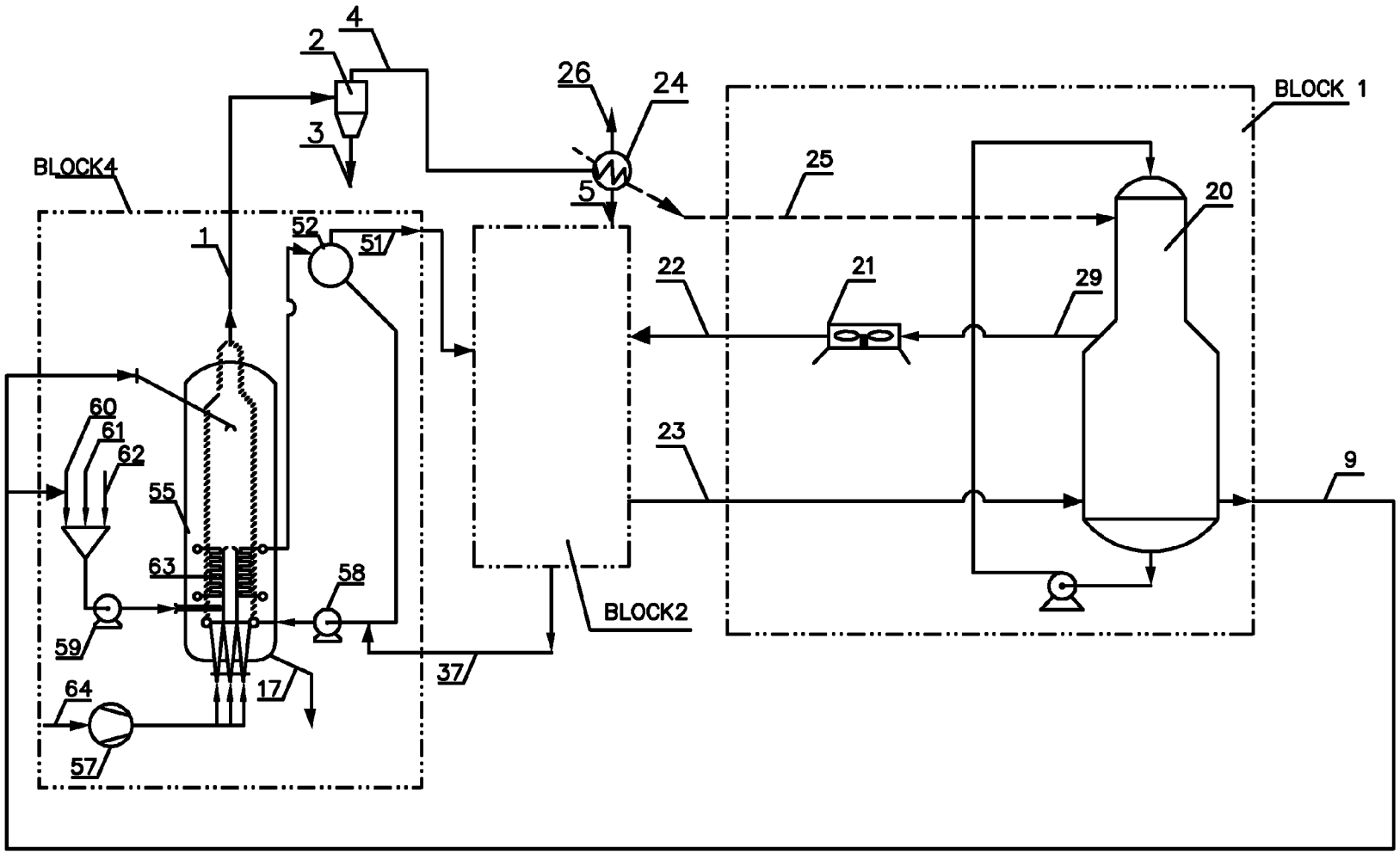
FIG. 17A is a schematic view, describing the use of Pressurized Fluid Bed Boiler used as a DCSG combined with evaporator.

FIG. 17A describes the use of Pressurized Fluid Bed Boiler used as a DCSG combined with evaporator. FIG. 17A includes the use of Fluid bed boiler instead of the DCSG rotating enclosure of FIG. 17. Block 4 includes a direct Contact steam generator unit with a standard non-direct steam generator boiler. PFBC (Pressurized Fluid Bed Combustion) boiler 55 that generates steam for EOR and pressurized combustion gases and steam with heat recovery to operate the evaporation unit (or set of evaporators in parallel). Examples of pressurized boilers that can be used in BLOCK 4 are the Pressurized Internally Circulating Fluidized-bed Boiler (PICFB) developed by Ebara, and the Pressurized-Fluid-Bed-Combustion-Boiler (PFBC) developed by Babcock-Hitachi. Any other medium-low pressurized combustion boilers that can combust solid fuels like petcoke or coal with the ability to use large quantities of solids rich, low quality water can also be used as well. BLOCK 4 is a prior art pressurized fluid bed boiler. Air 64 is compressed 57 and supplied to the bottom of the fluid bed to support combustion. Fuel 62, like petcoke, is crushed and grinded together with Lime Stone, possibly with Dolomite 61 and water 60 that includes the discharge brine water 9, to generate a pumpable slurry 59. The boiler includes internal heat exchanger 63 to generate high pressure steam 51 from distilled water 37. The steam 51 is generated from steam boiler drum 52 with boiler water circulation pump 58. The produced steam 51 is supplied to the EOR facility in BLOCK 2 where it can injected into an injection well for EOR. The combustion pressurized gas 1 is at pressures between 103 kpa and 2 MPa (typically less then 1 MPa) and temperatures between 300 C and 900 C. The temperature at the discharge will be lower due to the injection of the brine water 9 and its endothermic phase change energy. The combustion gas is rich with steam from the brine injected to the fluidized boiler 55, making the boiler 55 a DCSG due to the direct contact between the brine and the combustion gas inside the enclosure of fluid boiler 55. Brine water discharged from the distillation facility in BLOCK 1 is mixed with the fuel and possibly with the pressurized combustion gas to generate a stream of steam-rich gas and solids 13. Lime stone can be added to the brine water 9 or the fuel 62 injected into the fluid bed boiler. The solids are separated and removed directly from the boiler fluid bed bottom section 17 or from the boiler discharge gas 1 through commercially available gas-solids separation units 3 (like cyclones, electrostatic filters etc). The separated solids 17 and 3 are discharged for disposal. Another option is to add a pressurized wet scrubber with saturated water for scrubbing solid remains from flow 1 and recycling the solid rich water from the scrubber bottom back to the fluid bed boiler with the brine water 9 (not shown). The steam rich combustion gas 1 flows to heat exchanger/condenser 24. The steam in gas flow 1 is condensed to generate condensate 5 which is supplied to the water treatment plant and the steam generation facility. The NCG (Non-Condensation Gas) 26 is released to the atmosphere, possibly after expansion through a turbo expander to recover part of the compression energy. It can also be directed for further treatment to recover the CO2. The heat 25, recovered in heat exchanger 24, is used to operate the evaporating system and possibly the crystallizer in BLOCK 1 (a commercially available package). The evaporator was described in FIG. 17. The solid rich water discharge from evaporator 20 is recycled as described to generate an overall ZLD system.

Figure 18:
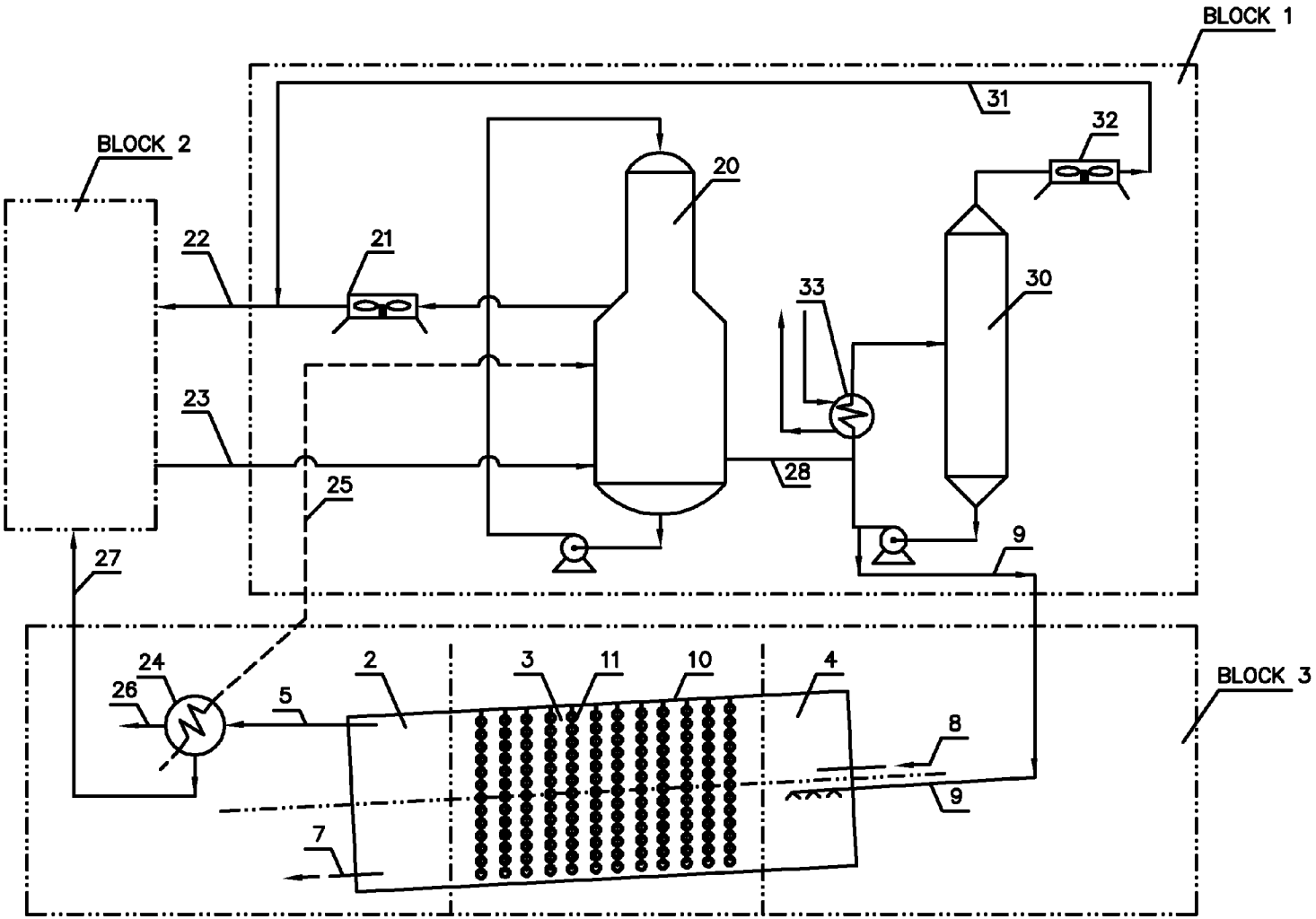
FIG. 18 is a schematic view, describing the use of an evaporation and crystallizer facility with a rotating direct contact steam generation enclosure.

FIG. 18 describes the use of an evaporation and crystallizer facility with rotating direct contact steam generation enclosure. BLOCK 3 includes the DCSG as described in FIG. 2 and FIG. 17. The solids 7 are discharged in a stackable form, and are suitable for landfill. The condensed water 27 supplied to BLOCK 2 for EOR. The recovered heat 25 is used to operate the evaporator 20 and possibly the crystallizer 30. The heat can be transferred to the evaporator or crystallizer in any available form. Low pressure steam can be generated in heat exchanger 24 and sent as the heat medium to the evaporator and the crystallizer. Another option is to use a heat transfer fluid, such as glycol or silicon based oil, to recover the heat in heat exchanger 24. Another option (not shown) is to eliminate the use of heat exchanger 24 and direct the gas and steam mixture 5 discharging from enclosure 10, possibly after treatment, to remove solids and acids, to the evaporator 20 to recover the heat and condense the water, while sending the condensed water from evaporator 20 to BLOCK 2. BLOCK 1 includes crystallizer 20, like a vertical falling film evaporator, as previously described in FIG. 17. Any other commercially available evaporator design can be used as well. The evaporator brine 28, if fed to a crystallizer 30, is like a forced circulation crystallizer. Any other commercially available crystallizer can be used as well. The crystallizer 30 includes a heating source 33, like a low pressure steam exchanger. The heat can be supplied from the DCSG discharge 5, as previously described to be used with the evaporator. The water vapor streams from the crystallizer are condensed through air coolers 32 to generate distillate water 31. The liquid water 31 is fed to BLOCK 2. To increase system efficiency, the vapor heat can be used for heating the feed water or brine. There are several commercially available systems, as described in BLOCK 1, that include an additional heat exchanger for improving the thermal efficiency of the overall system. The heat 33 to operate the crystallizer can be extracted from any other source of low pressure steam.

Figure 18A:
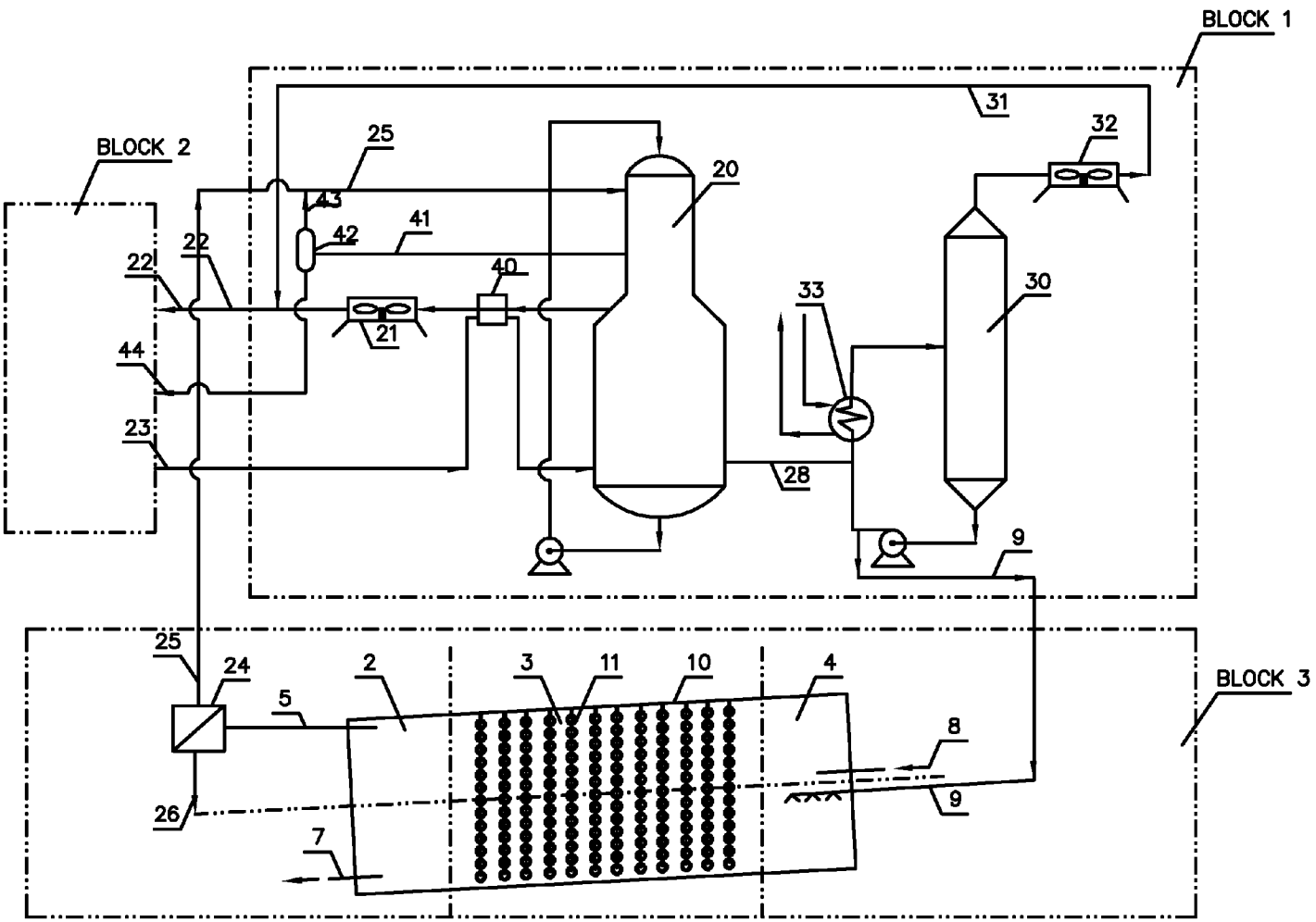
FIG. 18A is a schematic view, describing the use of a crystallizer as the condenser for the steam generated by a rotating enclosure ZLD steam generator.

FIG. 18A describes the use of a crystallizer as the condenser for the steam generated by a rotating enclosure ZLD steam generator. BLOCK 2 includes a rotating DCSG that consumes the solid rich brine 9 from an evaporator or a crystallizer. The generated steam and gas 5 are cleaned in a commercially available gas cleaning facility 24 to remove solids remains 26. The solids free gas 25 flows directly to the heat transfer section in an evaporator where the heat is used indirectly to recycle brine. The heat exchange section will be made from a corrosion resistance material due to the presence of CO2 and possibly other acid gas traces within the NCG combustion gas which may then be present in the produced gas and steam flow 5 leaving enclosure 10. The liquid water is removed from the condensed flow 25 and directed to BLOCK 2. The NCG 43 is released to the atmosphere or removed for further treatment. To increase energy efficiency, the evaporated brine vapor leaving evaporator 20 heats the feed 23 sent to the evaporator in heat exchanger 40. The remaining vapor is condensed in air coolers 21.

The improvements of the present invention reduce the need to remove solids from the discharge flow. The chains and mounted discharge hopper allow the enclosure to form a non-flowing slurry during rotation. As such, the solid removal is integrated into the overall process, being concurrent with other steps in the process instead of being an isolated separate step.

I claim:

1. A system for generating a mixture of steam and combustion gas through direct contact, using high solids content water and without waste liquid discharge, said system comprising:

a longitudinally rotatable drum, being mounted at a slope and under a controllable pressure and having a combustion gas supply section, a heat exchange section, and a discharge section, said discharge section being placed opposite said combustion gas supply section, said combustion gas supply section having an inlet, said rotatable drum having an outlet at an end thereof;

a means for injecting water at a highest point of said rotatable drum along the slope;

a means for discharging the mixture of steam and combustion gas at a lower end of said rotatable drum; and a means for separating solids from a gas phase of a portion of the mixture of steam and combustion gas connected to said discharge section.

2. The system for generating a mixture of steam and combustion gas, according to claim 1, further comprising:

a means for scrubbing a portion of the mixture of steam and combustion gas being in fluid connection to an end of the rotatable drum.

3. The system for generating a mixture of steam and combustion gas, according to claim 1, wherein said combustion gas is generated internally by the combustion of at least one of a group consisting of: carbon and hydrocarbon, with oxygen containing gas, inside the rotatable drum.

4. An apparatus for generating steam and stackable solid waste, said apparatus comprising:

a rotatable steam generating enclosure, being pressurized and having a water injection section, a steam producing section and a solids discharge section, said steam producing section being positioned at a middle of the rotatable enclosure, the rotatable enclosure having a means for injecting water into the rotatable enclosure at an inlet, and an outlet at an end of said rotatable steam generating enclosure; and a means for spraying water on said a portion of said solids discharge section.

5. The apparatus for generating steam and stackable solid waste, according to claim 4, further comprising:

a means for collecting and extracting solids, said means for collecting and extracting being rotatable and positioned perpendicular to an end of the rotatable enclosure.

6. A method for generating steam, combustion gas and stackable solids without liquid waste discharge for oil production, said method comprising of the following steps:

introducing thermal energy into an enclosure, said enclosure comprising means to enhance heat transfer, and having a water injection inlet, a steam producing section and a steam discharge outlet;

injecting a mixture of fluid containing waste solids into the enclosure through said water injection inlet;

mixing said fluid containing solids to generate steam in said enclosure, wherein combustion gas heat inside the enclosure converts said fluid containing solids into a gas phase, a liquid phase, and solids phase; and recovering said gas phase from the enclosure for oil extraction.

7. The method of claim 6, wherein said thermal energy is comprised of combustion gas, wherein said liquid phase and said solids phase flow in parallel direction to a combustion gas flow direction.

8. The method of claim 6, wherein said thermal energy is comprised of combustion gas, wherein said liquid phase and said solids phase flow in an opposite direction to a combustion gas flow direction.

9. The method of claim 6, wherein water injected through said water injection inlet is from a crystallizer.

10. The method of claim 6, further comprising:

directing said gas phase to an oil extraction facility.

* * * * *